US009816717B1

(12) United States Patent
Lawrence

(10) Patent No.: US 9,816,717 B1
(45) **Date of Patent: *Nov. 14, 2017**

(54) 80/90 CFM BATH FAN WITH TELESCOPING SIDE EXTENSION BRACKETS AND SIDE BY SIDE MOTOR AND BLOWER WHEEL

(71) Applicant: Chien Luen Industries Co., Ltd., Inc., Oakland Park, FL (US)

(72) Inventor: Tom Lawrence, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/237,475

(22) Filed: Aug. 15, 2016

Related U.S. Application Data

(63) Continuation of application No. 13/219,326, filed on Aug. 26, 2011, now Pat. No. 9,416,989.

(60) Provisional application No. 61/384,072, filed on Sep. 17, 2010.

(51) Int. Cl.

| | |
|---|---|
| ***F24F 7/00*** | (2006.01) |
| ***F24F 7/06*** | (2006.01) |
| ***F24F 13/20*** | (2006.01) |

(52) U.S. Cl.
CPC ..... *F24F 7/065* (2013.01); *F24F 13/20* (2013.01); *F24F 2007/001* (2013.01); *F24F 2221/02* (2013.01)

(58) Field of Classification Search
CPC ..... F24F 13/078
USPC ..... 454/292, 293, 294; 417/423.15; 415/213.1
See application file for complete search history.

(56) References Cited

U.S. PATENT DOCUMENTS

| | | | |
|---|---|---|---|
| 1,823,479 | A | 9/1931 | Venderbush |
| 2,519,503 | A | 8/1950 | Rigaumont |
| 2,689,906 | A | 9/1954 | Corbett |

(Continued)

OTHER PUBLICATIONS

Tom, Lawrence, Office Action Summary dated Nov. 7, 2014 for U.S. Appl. No. 13/289,312, filed Nov. 4, 2011, 14 pages.

(Continued)

*Primary Examiner* — Vivek Shirsat
(74) *Attorney, Agent, or Firm* — Brian S. Steinberger; Law Offices of Brian S. Steinberger, P.A.

(57) ABSTRACT

Apparatus, systems and methods of 80/90 CFM ventilation exhaust fans for bathrooms with telescoping side extension brackets and side by side electric driven motor and blower wheel, and being used with or without lights. The exhaust fans can include a single main housing, that allows for a blower housing to support the motor and a blower wheel in a side by side arrangement. The exhaust fans can further include an outside wiring box that is externally located to the main housing. The wiring box can have support male plugs and female receptacles for supplying an electrical power supply to the electric motor and light. The side extension brackets can include telescoping members that allow the exhaust fans to be easily attached to structural members inside of a ceiling so that the exhaust fan has a vent cover attached to the ceiling. Inside of the exhaust fans can be light box with closed sides and bottom which prevents incoming air from passing directly onto the lights. Instead incoming air is drawn to pass around the outside of the light box so that the light box functions as a heat sink reducing the heat generated from the light.

12 Claims, 22 Drawing Sheets

(56) References Cited

U.S. PATENT DOCUMENTS 2,697,163 A 12/1954 Spear
2,798,659 A 7/1957 Tweedy
2,950,859 A 8/1960 Kirk
3,065,686 A 11/1962 Geocaris
3,068,341 A * 12/1962 Ortiz ..... F21S 8/02 219/220
3,125,943 A 3/1964 Geocaris
3,223,019 A 12/1965 Schuh
3,227,063 A 1/1966 Lambert
3,246,137 A 4/1966 Zagel
3,306,179 A 2/1967 Russell
3,309,502 A 3/1967 Witherspoon
3,665,838 A 5/1972 Shepherd
3,785,271 A 1/1974 Joy
3,796,249 A 3/1974 McCabe
3,909,589 A 9/1975 Stone
4,510,851 A 4/1985 Sarnosky
4,526,318 A 7/1985 Fleming
4,537,117 A 8/1985 Cavestany
4,589,476 A 5/1986 Berner
4,616,696 A 10/1986 Brundrett
4,657,291 A 4/1987 Kurosaki
4,681,024 A 7/1987 Ivey
4,726,559 A 2/1988 Hultmark
4,798,518 A 1/1989 Holzberger
4,867,640 A 9/1989 Penlesky
4,954,049 A 9/1990 Armbruster
5,232,152 A 8/1993 Tsang
5,567,200 A 10/1996 Swartzendruber
5,620,370 A 4/1997 Umai
5,934,783 A 8/1999 Yoshikawa
6,161,175 A 12/2000 Kim
6,215,885 B1 4/2001 Geiger
6,261,175 B1 7/2001 Larson
6,329,908 B1 12/2001 Frecska
6,340,237 B1 1/2002 Koga
D457,232 S 5/2002 Miura
D457,616 S 5/2002 Yamanaka
6,384,352 B1 5/2002 Ellman et al.
6,488,579 B2 12/2002 Larson
6,538,881 B1 3/2003 Jeakins
6,632,006 B1 10/2003 Rippel
6,802,770 B2 10/2004 Larson
6,897,580 B2 5/2005 White
6,979,169 B2 12/2005 Penlesky
D521,145 S 5/2006 Craw
7,055,582 B2 * 6/2006 Erisgen ..... F04D 29/582 165/122
7,128,303 B2 10/2006 Penlesky
D535,433 S 1/2007 Craw
7,175,309 B2 2/2007 Craw
7,203,416 B2 4/2007 Craw
D565,716 S 4/2008 Jacak
D575,387 S 8/2008 Zakula
D577,805 S 9/2008 Adrian
D581,508 S 11/2008 Miyake
7,455,432 B2 11/2008 Craw
7,455,500 B2 11/2008 Penlesky
7,481,559 B1 1/2009 Rashidi
7,591,867 B2 9/2009 Choi
7,606,379 B2 10/2009 Ivey et al.
7,654,495 B2 2/2010 Adrian
7,677,964 B1 3/2010 Bucher
7,845,803 B2 12/2010 Lv
7,881,827 B2 2/2011 Park et al.
7,922,335 B2 4/2011 Sakai
7,993,037 B1 8/2011 Buse
8,033,687 B2 10/2011 Wang
D653,323 S 1/2012 Jacak
8,104,502 B2 1/2012 Nakata
D654,998 S 2/2012 Zakula
8,113,148 B2 2/2012 Chem
8,172,655 B2 5/2012 Liu
8,218,805 B2 7/2012 Hornback
8,295,504 B2 10/2012 Ady et al.
D681,249 S 4/2013 Tom
8,434,916 B2 5/2013 Craw
8,485,696 B2 7/2013 Pringle et al.
8,591,037 B2 11/2013 Nagumo
8,814,513 B2 8/2014 Yang
8,956,113 B2 2/2015 Yang
8,961,126 B1 2/2015 Tom
9,022,622 B2 5/2015 Craw
9,022,846 B1 5/2015 Tom
9,028,212 B1 5/2015 Tom
9,097,265 B1 8/2015 Tom
9,103,104 B1 8/2015 Tom
9,175,874 B1 11/2015 Tom
9,188,132 B1 11/2015 Tom
9,414,142 B1 8/2016 Zauher
2003/0133815 A1 * 7/2003 Grant ..... F04D 29/646 417/423.15
2005/0006549 A1 1/2005 Liu
2005/0111972 A1 5/2005 Penlesky
2005/0117341 A1 6/2005 Craw
2006/0172693 A1 8/2006 Lundquist
2006/0199515 A1 9/2006 Lasko
2007/0131827 A1 6/2007 Nevers
2007/0201236 A1 8/2007 Craw
2008/0261508 A1 10/2008 Deng
2008/0318515 A1 * 12/2008 Yeung ..... F04D 29/4206 454/354
2009/0028372 A1 1/2009 Cerasuolo
2009/0073702 A1 3/2009 Craw
2009/0116189 A1 5/2009 Chang
2009/0170421 A1 * 7/2009 Adrian ..... F24F 7/06 454/349
2010/0009621 A1 1/2010 Hsieh
2010/0112927 A1 5/2010 Marga
2010/0112929 A1 5/2010 Iantorno
2010/0171681 A1 7/2010 Cabanas et al.
2010/0226139 A1 9/2010 Lynch
2010/0328960 A1 12/2010 Wang
2012/0250335 A1 10/2012 Nakano
2012/0274767 A1 11/2012 Hornback
2013/0084793 A1 4/2013 Yang et al.
2013/0114826 A1 5/2013 Chang
2013/0266443 A1 10/2013 Yang
2013/0272002 A1 10/2013 Craw
2013/0315731 A1 11/2013 Yang
2014/0112781 A1 4/2014 Yang
2014/0177900 A1 6/2014 Berkman
2015/0110626 A1 4/2015 Yang

OTHER PUBLICATIONS

Tom, Lawrence, Listing of pending claims for U.S. Appl. No. 13/289,312, filed Nov. 4, 2011, 7 pages.
Tom, Lawrence, Office Action Summary dated Oct. 22, 2014 for U.S. Appl. No. 13/042,992, filed Mar. 8, 2011, 16 pages.
Tom, Lawrence, Listing of pending claims for U.S. Appl. No. 13/042,992, filed Mar. 8, 2011, 7 pages.
Tom, Lawrence, Office Action dated Jan. 8, 2015 for U.S. Appl. No. 13/233,700, filed Sep. 15, 2011, 25 pages.
Tom, Lawrence, Amendment Response filed Oct. 3, 2014 for U.S. Appl. No. 13/233,700, filed Sep. 15, 2011, 13 pages.

* cited by examiner

80/90 CFM BATH FAN WITH TELESCOPING SIDE EXTENSION BRACKETS AND SIDE BY SIDE MOTOR AND BLOWER WHEEL

This application is a Continuation of U.S. patent application Ser. No. 13/219,326 filed Aug. 26, 2011, now U.S. Pat. No. 9,416,989, which claims the benefit of priority to U.S. Provisional Patent Application No. 61/384,072 filed Sep. 17, 2010. The entire disclosure of each of the applications listed in this paragraph are incorporated herein by specific reference thereto.

FIELD OF INVENTION

This invention relates to ventilation exhaust fans, and in particular to apparatus, systems and methods of 80 and 90 CFM (cubic feet per meter) ventilation exhaust fans for bathrooms with telescoping side extension brackets and side by side motor and blower wheel, and being used with or without lights.

BACKGROUND AND PRIOR ART

Various types of bathroom exhaust and ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al., which are all incorporated by reference.

There have been many problems with the prior art. For example, many bath fans are difficult to be installed into a ceiling since the housings cannot be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan.

Thus, the need exists for solutions to the above problems with the prior art.

SUMMARY OF THE INVENTION

A primary objective of the present invention is to provide exhaust and ventilation fans, apparatus, systems and methods for bathrooms with telescoping side extension brackets and side by side motor and blower wheel that provides 80 (eighty) CFM (cubic feet of air per minute) of airflow, that are with or without lights.

A secondary objective of the present invention is to provide exhaust and ventilation fans, apparatus, systems and methods for bathrooms with telescoping side extension brackets and side by side motor and blower wheel that provides 90 (ninety) CFM (cubic feet of air per minute) of airflow, that are with or without lights.

A third objective the present invention is to provide ventilation fans, apparatus, systems and methods for bathrooms having flush mounted light sources with exterior perimeter grill having at least one vent opening(s) for passing air to a blower inside of the housing where the air does not pass into the light source and on any lights under the light lens cover.

A fourth objective the present invention is to provide ventilation fans, apparatus, systems and methods for bathrooms having flush mounted light sources with exterior perimeter grill having at least one vent opening(s) so that incoming air is guided around a blower fan and out the side opening and out the side exhaust opening of a housing, in order to reduce excess noise from air movement.

A fifth objective the present invention is to provide ventilation fans, apparatus, systems and methods for bathrooms with or without light sources with telescoping leg(s) on at least one outer wall of a housing for the attaching the housing to joists within a ceiling.

A sixth objective the present invention is to provide ventilation fans, apparatus, systems and methods for bathrooms with or without light sources having an exterior electrical box with exterior wiring box located outside of the housing.

A preferred embodiment of an exhaust fan, includes a single one-piece housing having closed side walls, closed top and open bottom, a blower wheel inside of the housing, an electrical motor for rotating the blower wheel that is side by side with each other, and side extension brackets on the housing for mounting the housings to support structures within a ceiling.

The motor can be an 80 (eighty) CFM (cubic feet per minute) generating motor. The motor can be a 90 (ninety) CFM (cubic feet per minute) generating motor.

The side extension brackets can include a first elongated side telescoping bracket directly mounted along one side wall of the housing, and a second elongated side telescoping bracket directly mounted along an opposite side wall of the housing, the second elongated side telescoping bracket being shorter than the first elongated side telescoping bracket.

A removable grill can cover the open bottom of the housing. Alternatively, a removable light shade can be separately detachable and attachable to the removable grill and light. A light box having closed sides and closed bottom can be included with the light being mountable inside of the light box, wherein air being drawn into the main housing by the blower passes around sides of the light box allowing for reducing heat generated from the light.

The exhaust fan can include a wiring box attached to an exterior side of the housing, wherein the wiring box includes a male plug and a female receptacle inside of the box for supplying an external power supply to the electrical motor.

The exterior mounted wiring box can also be used for supplying power connections to run the electrical motor and to power the light. The wiring box can include a first male plug and a first female receptacle inside of the box for supplying the external power supply to the electrical motor, and a second male plug and a second female receptacle inside of the box for supplying the external power supply to the light.

The blower wheel can be oriented in a vertical orientation, which improves airflow through the housing.

The light shade can include an elongated member which adjusts height of the shade relative to the housing.

Another embodiment of the ventilating exhaust fan, can include a single housing having closed side walls, closed top and open bottom, a blower wheel housing, a blower wheel inside of the blower wheel housing, an electrical motor for rotating the blower wheel that is side by side with each other inside of the blower wheel housing, a light supported by a support member attached to the housing, a grill cover having vents and a light shade for covering the housing, wherein incoming air into the housing passes to the blower wheel without contacting the light, a wiring box attached to an exterior surface of the single housing for supporting external wire connections for both the motor and the light, and side extension brackets on the housing for mounting the housings to support structures within a ceiling.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
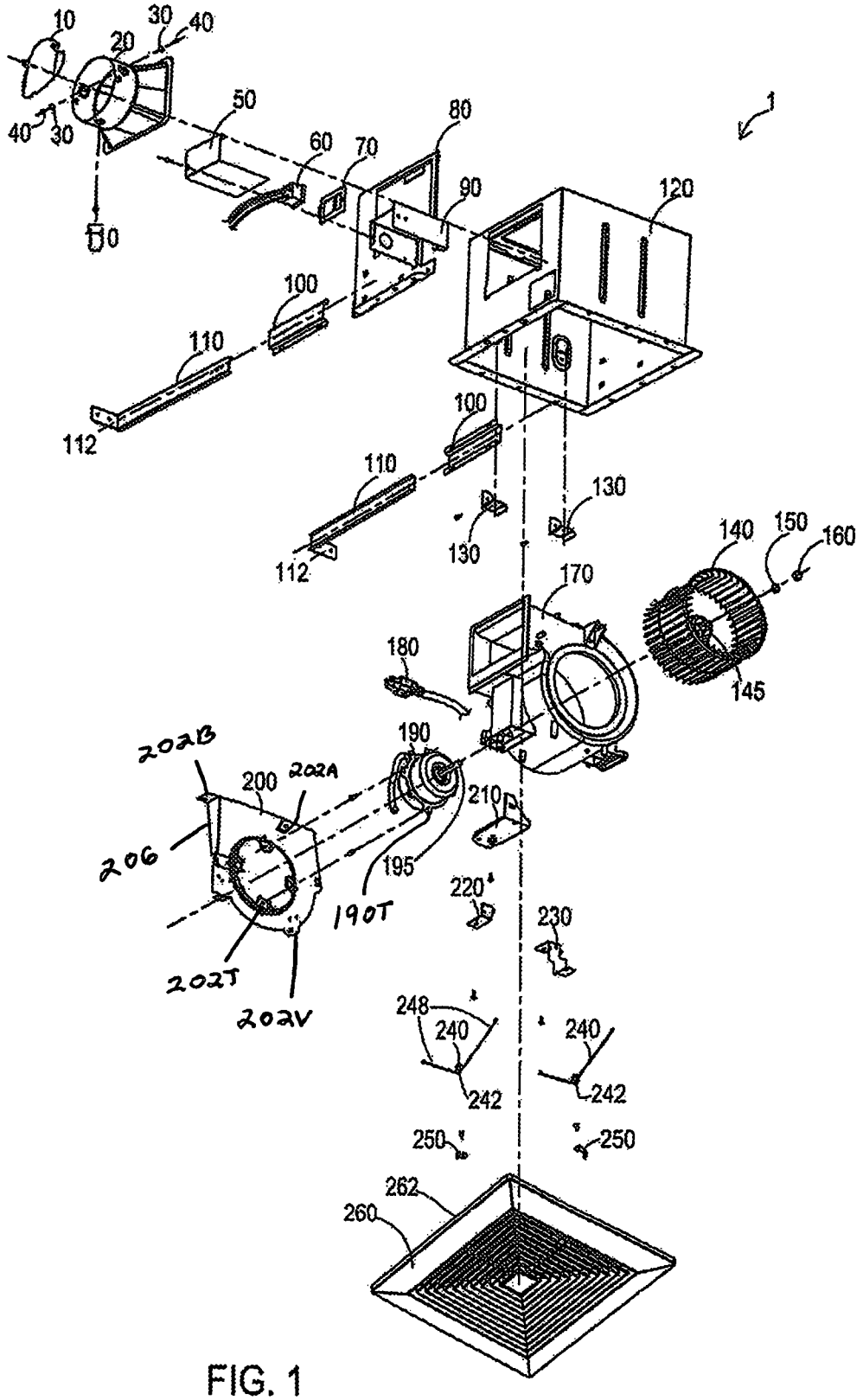
FIG. 1 is an exploded perspective view of an 80 CFM bath fan housing (with no heater) telescoping side extension brackets, side by side motor and blower wheel, with no light.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. telescoping side extension brackets 80 CFM Bath Exhaust Fans with Telescoping Side Extension Brackets (No Lights)

A list of the components for FIGS. 1-6 will now be described.

1. 80 CFM Bath Fan
10. Aluminum damper.
20. Outlet
30. install rubber (2)
40. Clinch
50. Wiring cover box
60. two or three pronged plug/socket (female)
65. external electrical connectors
70. Plug plate
80. Left side plate of housing
90. Plate for the wiring box
100. Bracket cover (2)
110. Suspension/Mounting bracket (2)
112. bent flange ends
120. Housing
122. open top
123. upper edge portions with rectangular flaps
128. closed bottom
130. Fixing iron (2)
140. Blower wheel
145. wheel tower connector
150. Washer
160. M8 tower shape nut
170. Blower housing
175. interior chamber
178. exhaust outlet
180. Two or Three Pronged Plug (male)
190. Motor
190T tabs extending from motor
195. axle portion
200. Motor Installation Plate/Fitting seat for motor
202A, 202B. flanges on base edges of plate
202T tabs extending into opening
202V vertical tab extending from rounded top of plate 200
206 bent trapezoidal portion of plate
210. Cover of capacitor box
220. 7 shaped flange
230. Z shaped flange
240. Springs (2)
242. apex
248. legs
250. Spring clip fastener

260. Grill cover

262. inner protruding portions on grill cover edges

Figure 2:
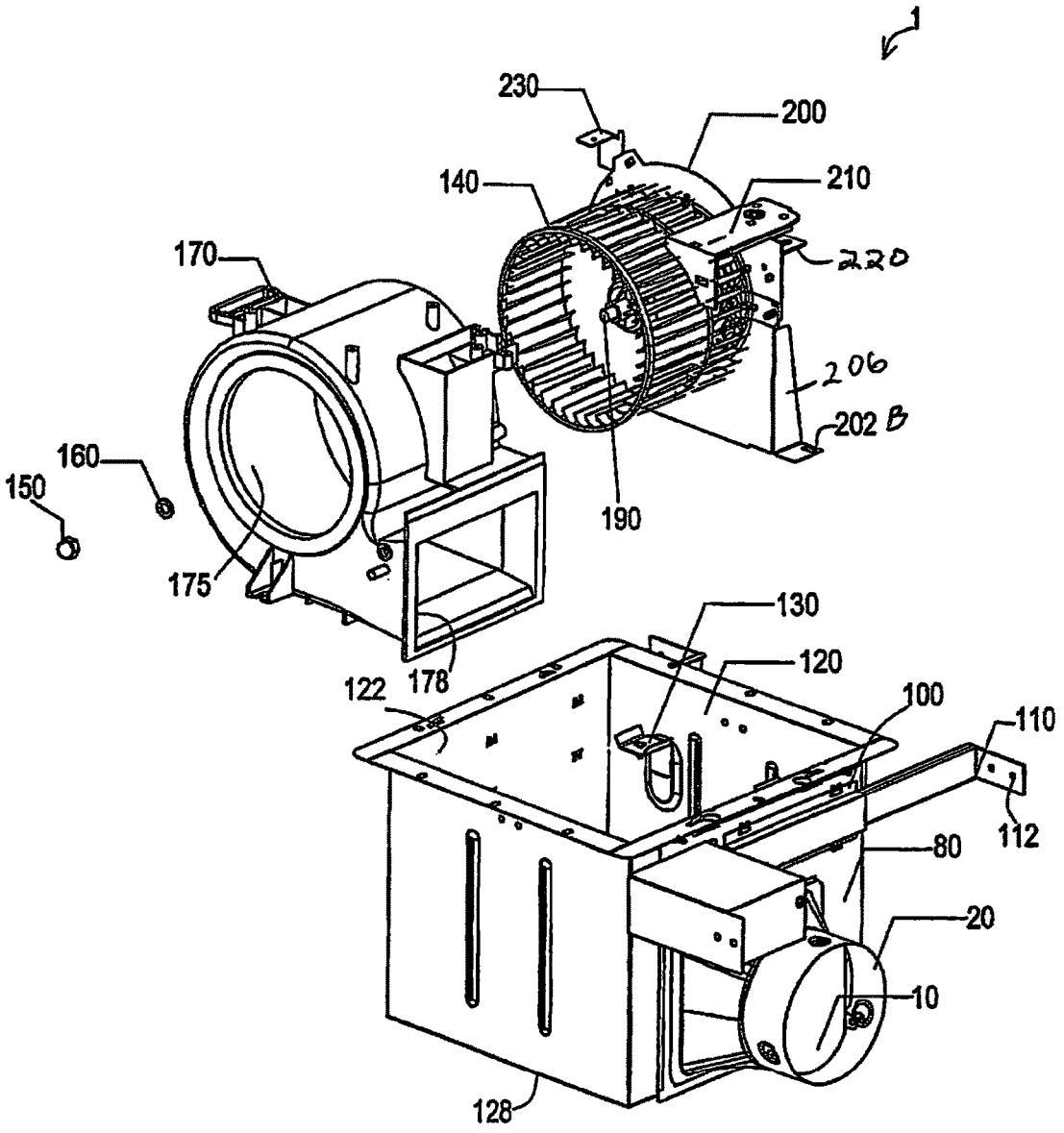
FIG. 2 is a partial exploded perspective view of the housing of FIG. 1 with blower housing separated from the blower wheel.
Figure 3:
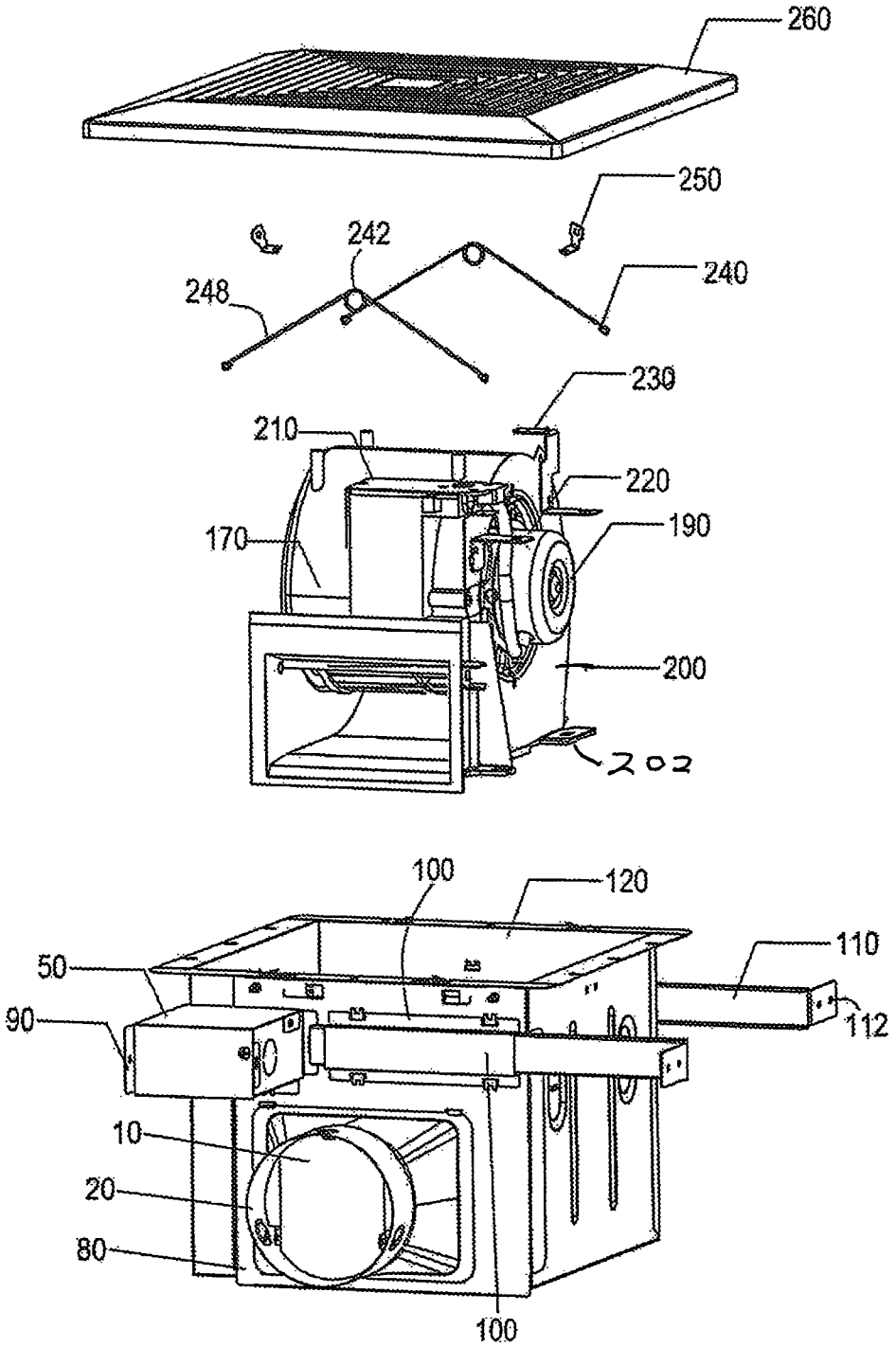
FIG. 3 is an exploded perspective view of the housing of FIG. 1 and blower wheel inside the blower housing along with the grille cover.
Figure 4:
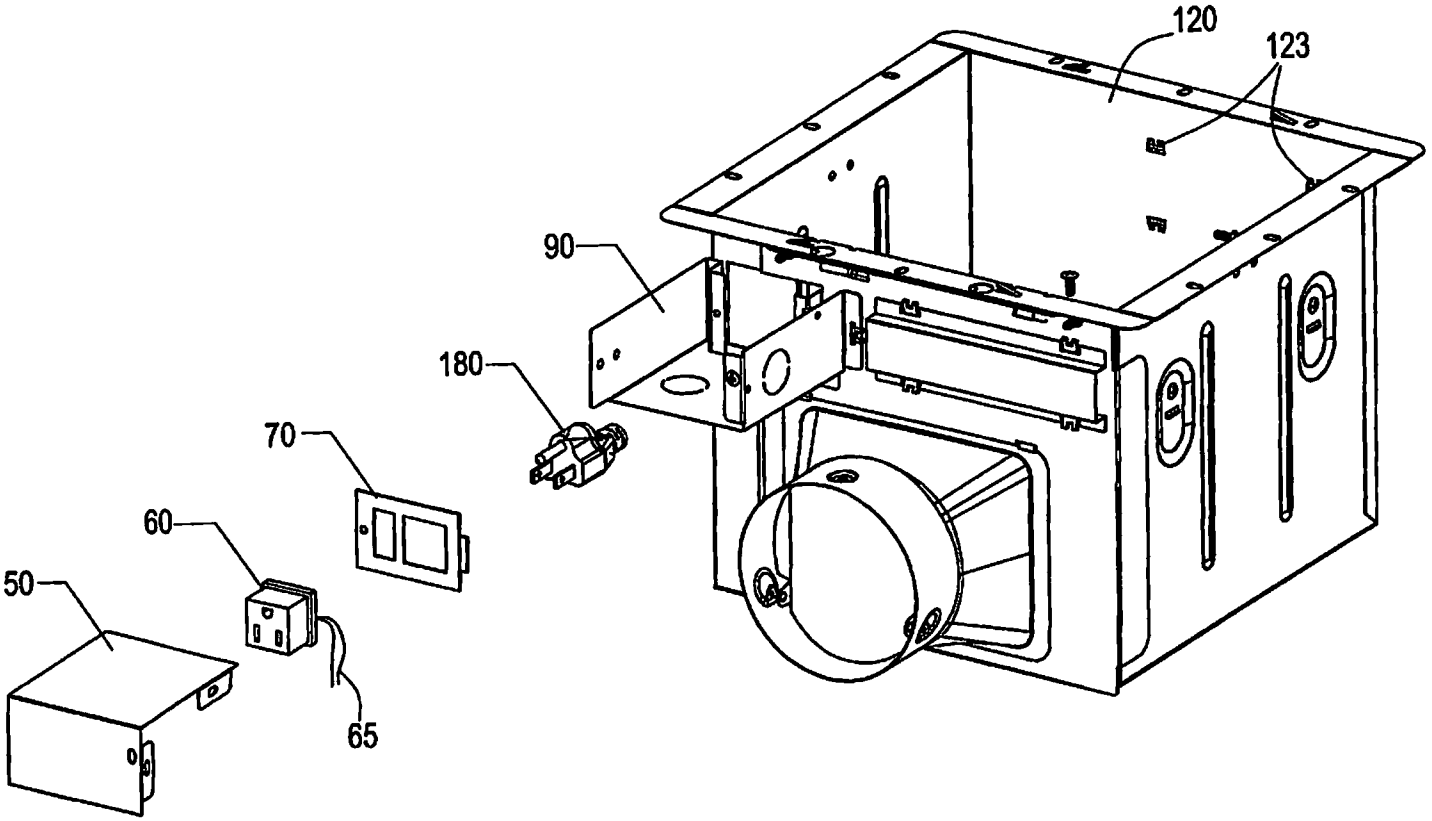
FIG. 4 is an exploded perspective view of the housing of FIG. 1 along separated from the wire box cover, female plug, plug plate, male pronged plug, and wiring box plate.
Figure 5:
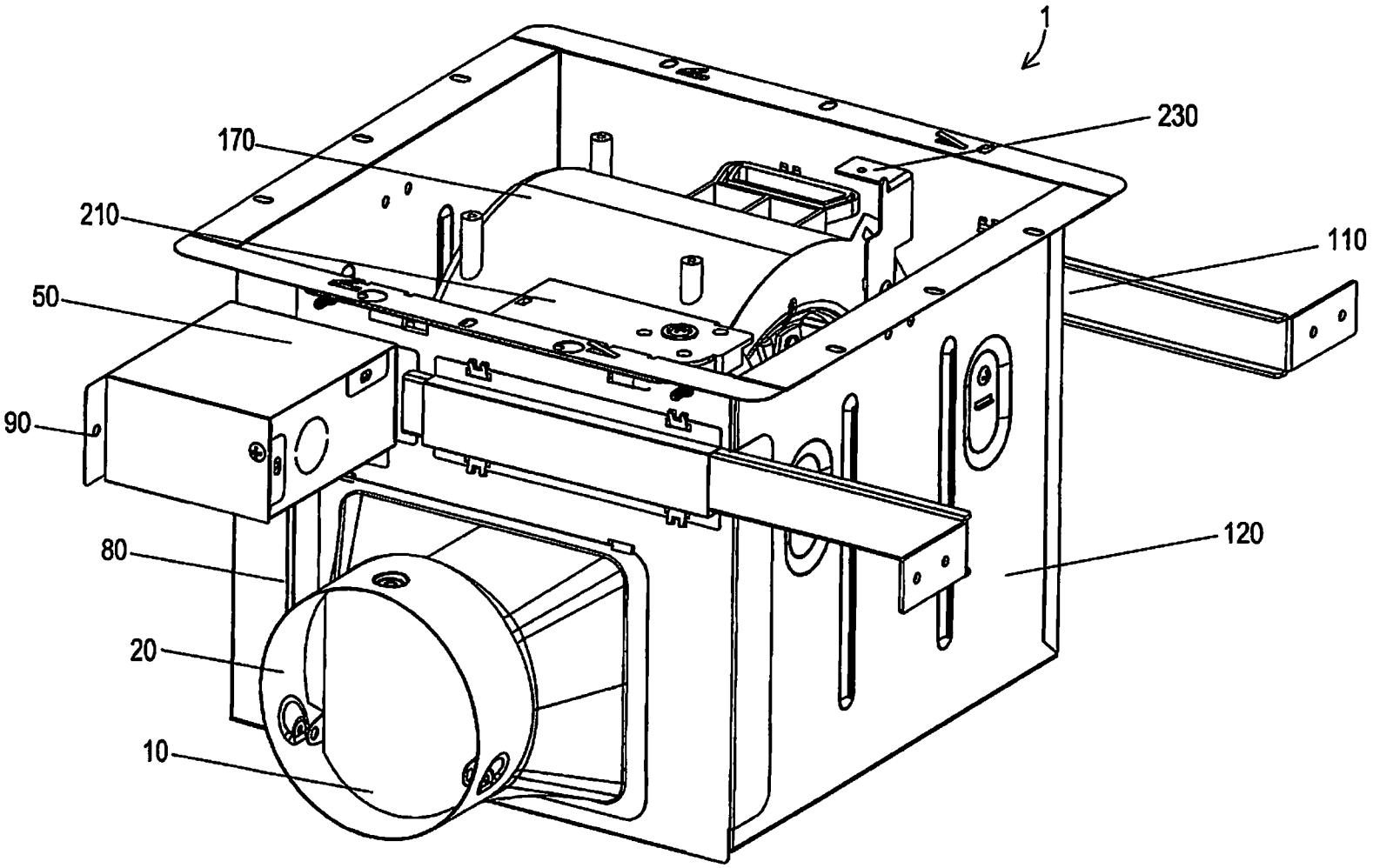
FIG. 5 is a perspective view of the assembled bath fan housing of FIG. 1 without grill cover.
Figure 6:
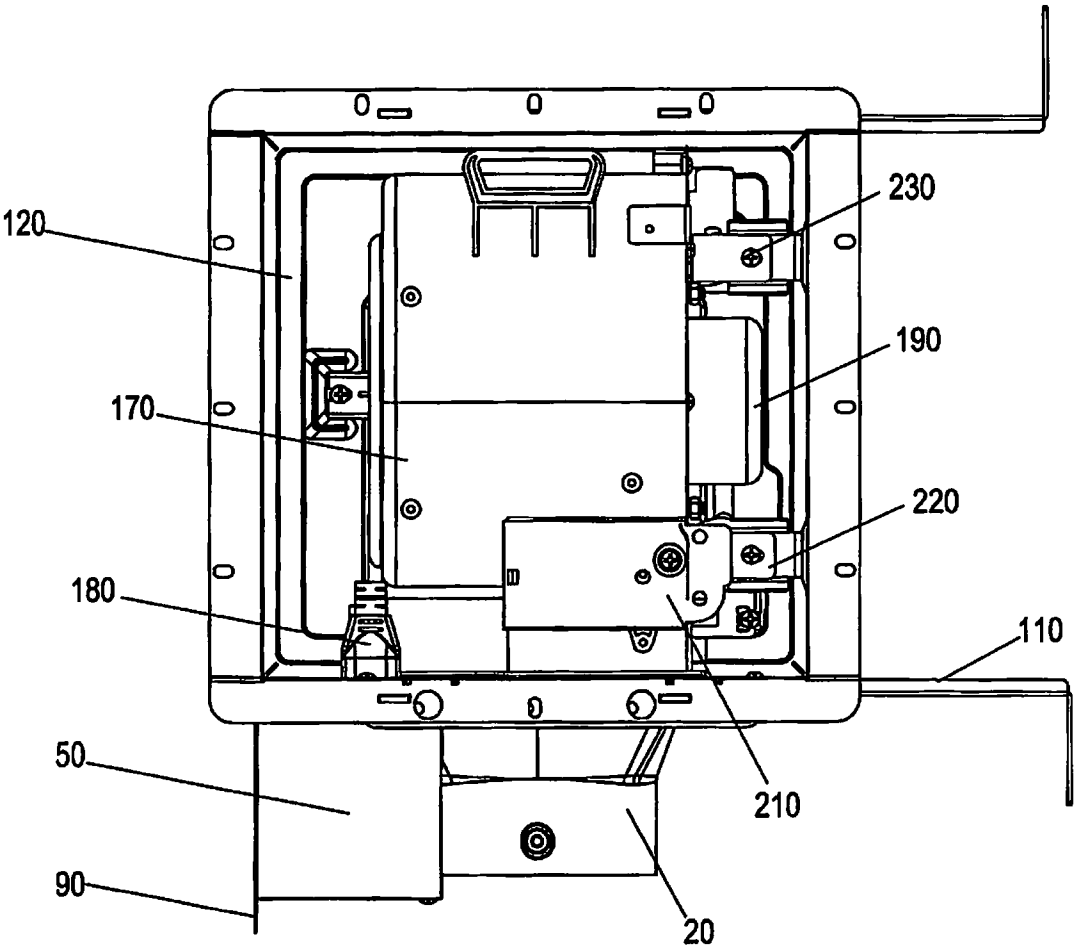
FIG. 6 is a top view of the assembled bath fan housing of FIG. 5 without grill cover.
Figure 7:
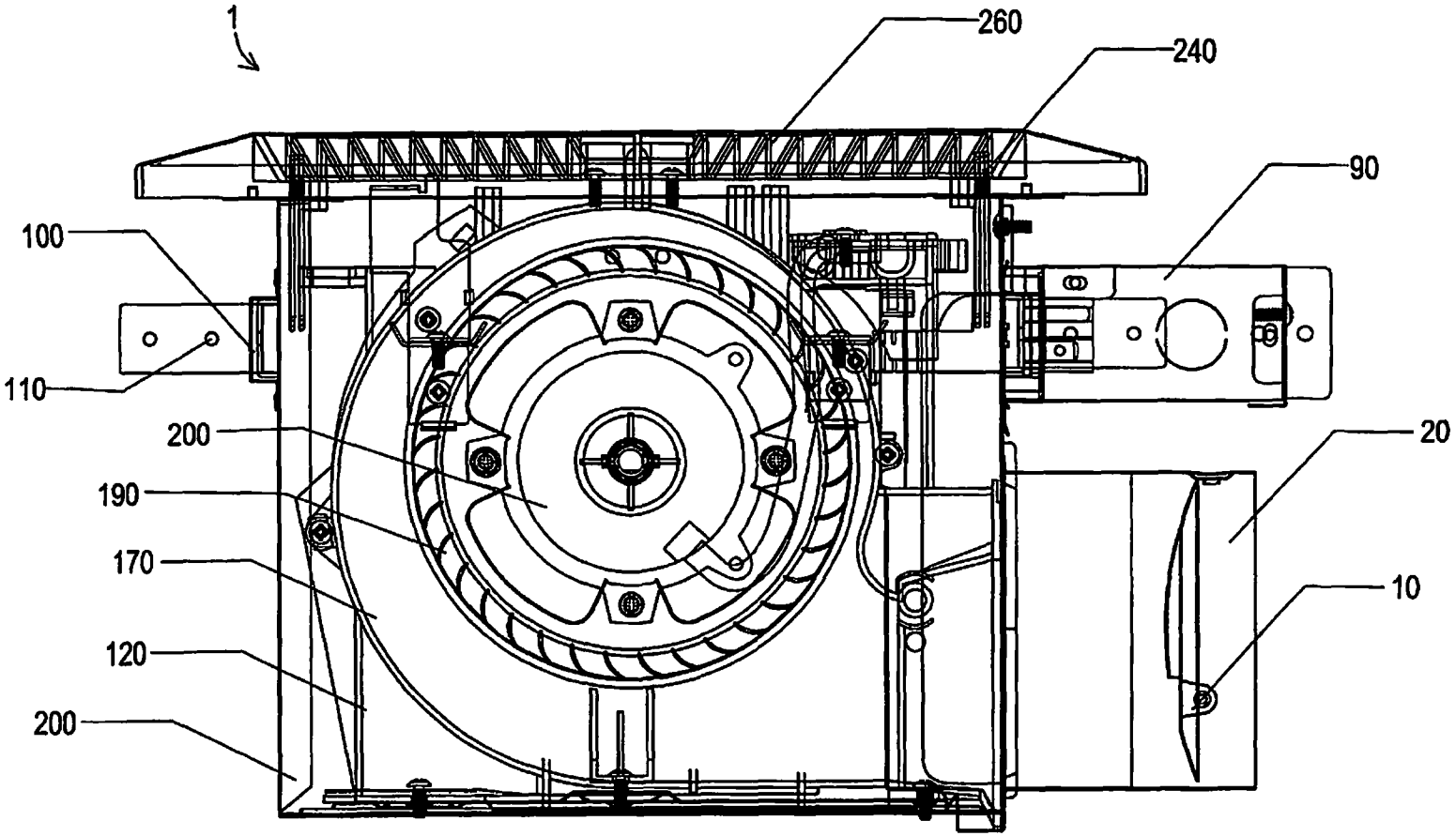
FIG. 7 is a side cross-sectional view of the assembled bath fan of FIG. 5 with grill cover.

FIG. 1 is an exploded perspective view of an 80 CFM bath fan 1 with housing 120 with no heater, telescoping side extension brackets 100, 110, side by side motor 190 with blower wheel 140, with no light. FIG. 2 is a partial exploded perspective view of the housing 120 of FIG. 1 with blower housing 170 separated from the blower wheel 140. FIG. 3 is an exploded perspective view of the housing 120 of FIG. 1 and blower wheel 140 inside the blower housing 170 along with the grille cover 260. FIG. 4 is an exploded perspective view of the housing 120 of FIG. 1 along separated from the wire box cover 50, female plug 60, plug plate 70, male pronged plug 180, and wiring box plate 90. FIG. 5 is a perspective view of the assembled bath fan housing 120 of FIG. 1 without grill cover 260. FIG. 6 is a top view of the assembled bath fan housing 120 of FIG. 5 without grill cover 260. FIG. 7 is a side cross-sectional view of the assembled bath fan 1 of FIG. 5 with grill cover 260.

Figure 18:
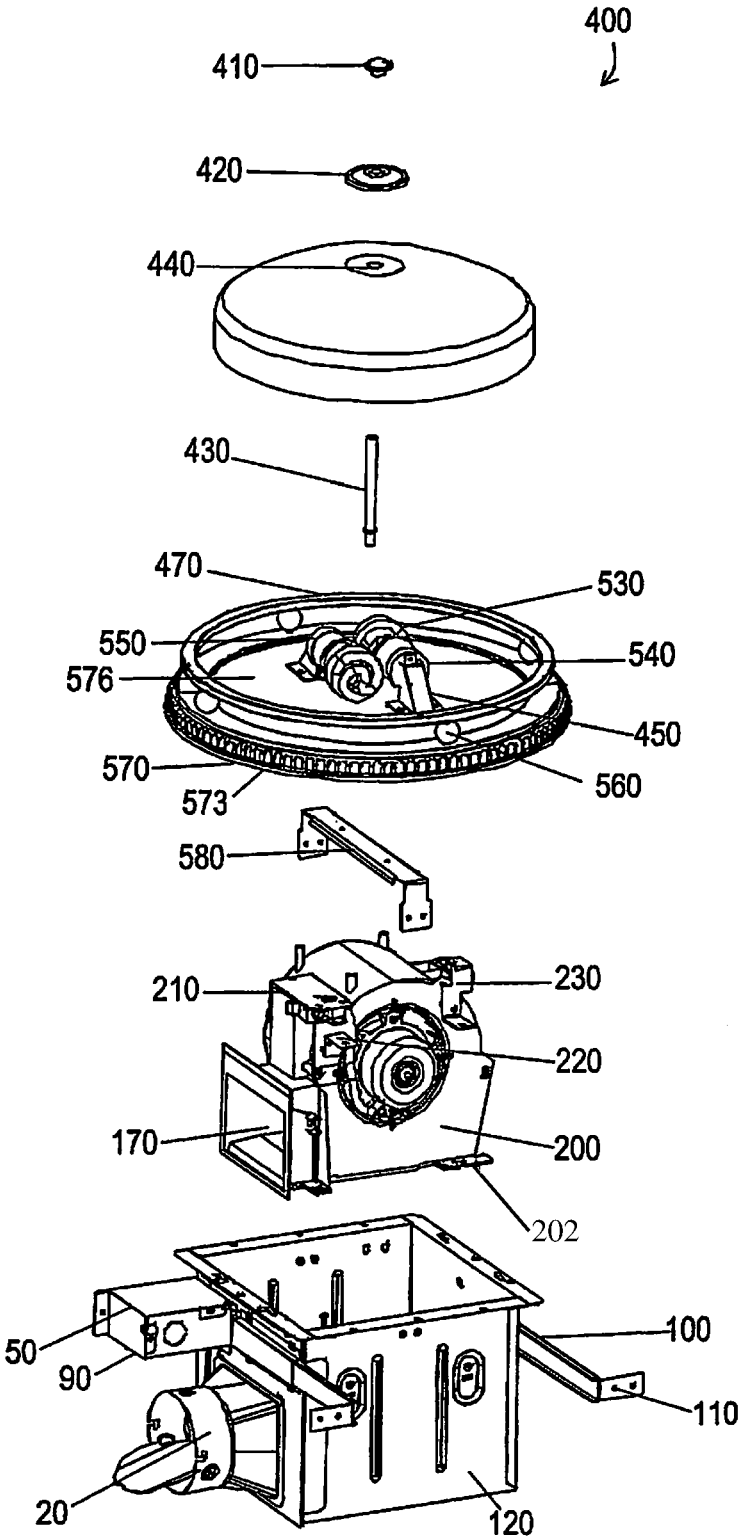
FIG. 18 is a partial exploded perspective view of FIG. 17 with assembled blower housing containing side by side motor and blower wheel with partial assembled light components.

Referring to FIGS. 1-7, main housing 120 can include a single box shape having three closed sides, and open top 122 with bent flange edges, and closed bottom 128. A blower housing 170 can have an open interior chamber 175 and exhaust outlet 178. Inside of the chamber 175 can be located a motor 190 with axle portion 195 that connects inside the middle tower connector 145 of a rotatable blower wheel 140, with a washer 150 and 160 tower nut 160. The motor 190 and blower wheel 140 can be side by side with one another within the blower housing 170 which is located in the main housing 120. The motor 190*m* assembled with the blower housing 170 (as shown in FIGS. 3 and 18) can be fixably held in place by vertical installation plate 200 inside of the main housing 120. Vertical plate 200 can have a circular opening which functions as a seat for the motor 190. Four tabs 202T equally spaced apart from one another can extend into the plate opening for attaching to four complementary tabs 190T on the motor 190. Installation plate 200 can be fastened as a bottom flat base edge to a closed bottom floor portion 128 inside of the main housing by fasteners that attach flange 202A and flange 202B which is off the bent trapezoidal portion 206 of the plate to the closed bottom floor portion 128. Vertical plate 200 can have a rounded top with a vertical tab 202V extending therefrom, and a flat straight base and straight sides extending from the flat straight base. Upper flange(s) 220, 230 on the side wall of the vertical plate 200 can be fastened to the inside of a closed outer side wall of housing 120 by mounted fixing iron(s) 130 using additional fasteners, and the like. Power to the motor 190 can be supplied by connector with two pronged male plug end 180.

The vertical blower wheel design 140 allows for a smaller housing dimension, but also performs just as well as a horizontal design. A vertical design can help improve airflow because of the way the air enters the blower wheel 140 and is pushed out through the outlet end.

One side of the main housing 120 can be an exhaust side (left side) 80, with a funnel shaped outlet 20 with a movable damper 10. On the outlet side 80 and opposite side of the housing 120 can be bracket covers 100 mounted directly to the housing 120. Slidable mounting brackets 110 each with bent ends 112.

Electrical power can be supplied to the fan housing embodiment through a wiring box plate 90 having two sides and closed bottom that is mounted to an exterior side of the main housing 120. Male plug 180 (which connects power to motor 190) can attach to socket 60 through the plug plate 70. The socket 60 can be connected by connectors 65 to an external electrical power supply. An L shaped wiring box cover 50 can close off the open top and side of the box plate 90. The external wiring box 90 allows for ease in connecting and disconnecting power to the motor 190 without having to open the main housing 120.

A pair of grill clips 240 can springably hold the grill cover 260 to the blower housing 120 (FIGS. 1, 3 & 4). The pair of grill clips 240 can each be scissor clips each having an apex 242 that can attach to an inner protruding portion along the lower edge 262 of the grill cover 260 by spring clip fasteners 250. The cover 260 can be attached by pressing together the legs 268 of the clips 260, so that the legs 268 can be inserted to catch inside upper ledge portions 123 of the blower housing 120. There can be a rectangular flap 123 that allows the spring clips 240 to sit inside the blower housing 120 and held in place once the clips 240 are in the open position.

The capacitor box cover 210 acts as a protection for the wiring and also secures 175 to the bath fan housing. The 7 shaped flange 220 is the bottom piece of 210 that has an opening for the screw to fasten to fixing iron 130 on the bath fan housing. The Z shaped flange 230 is the same as 220 where it has an opening for a screw to secure to the fixing iron 130 on the bath fan housing.

Figure 8:
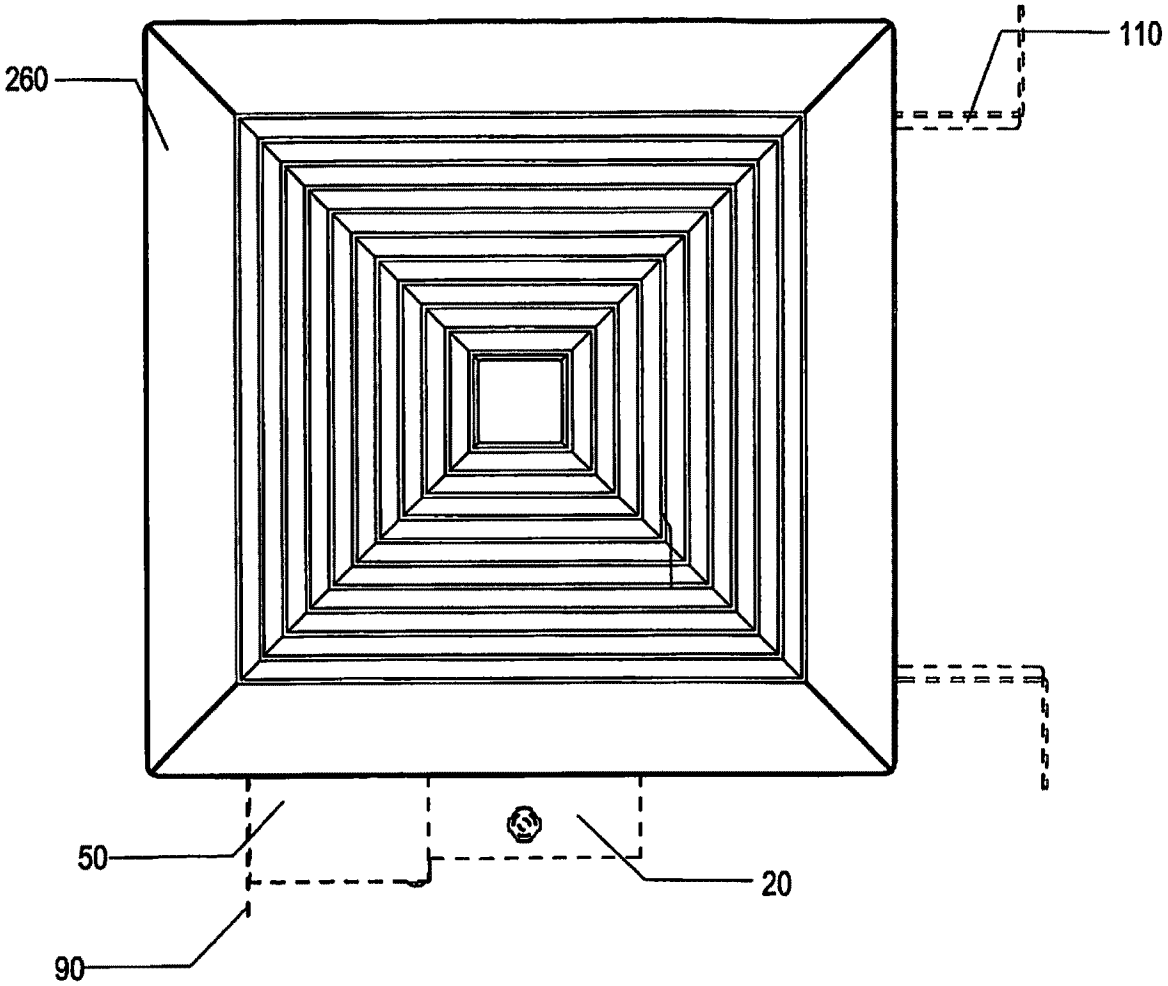
FIG. 8 is a top view of the assembled bath fan housing of FIG. 6 with grill cover.
Figure 9:
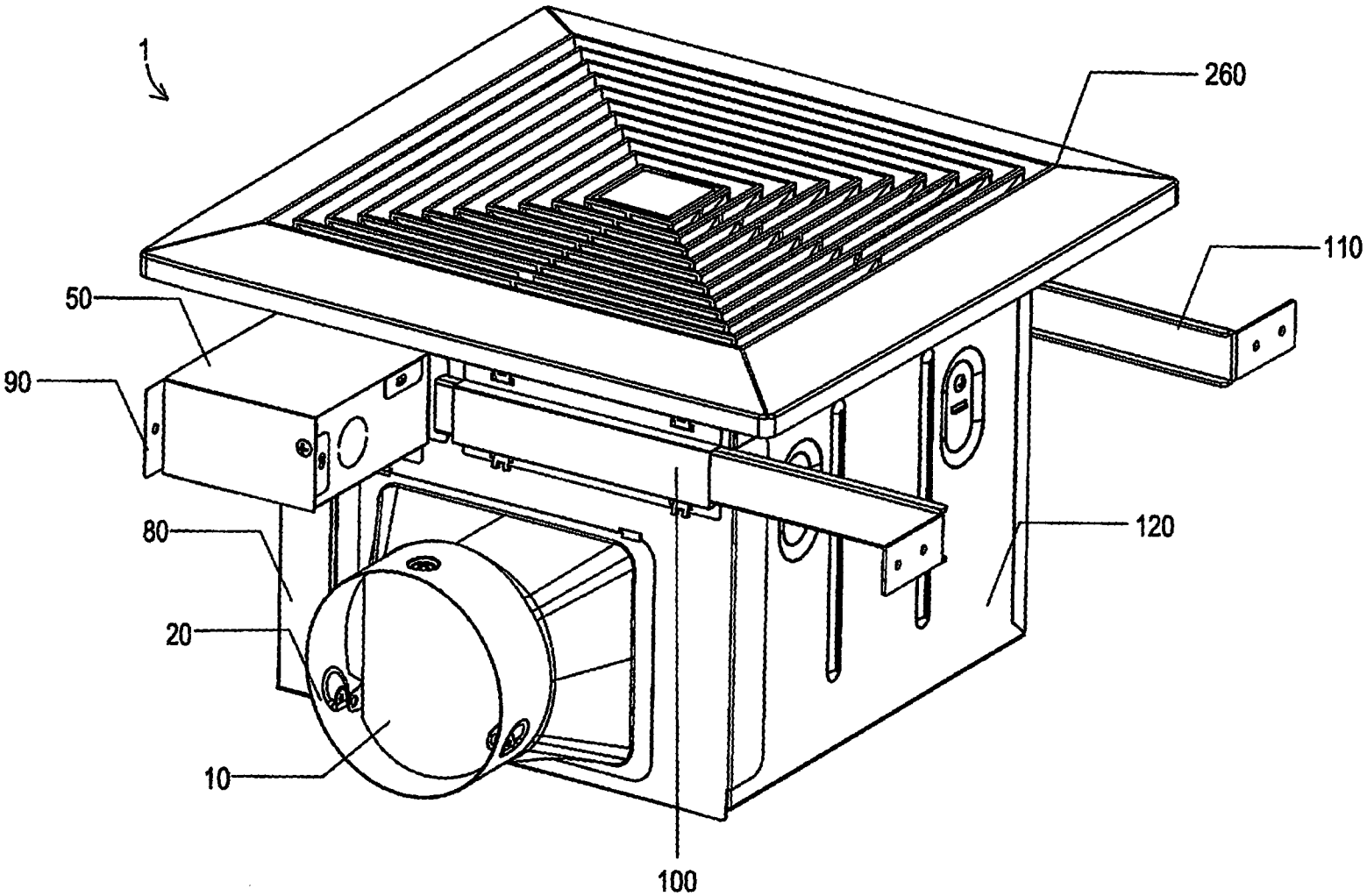
FIG. 9 is a top right front perspective view of the assembled bath fan housing of FIG. 8.
Figure 10:
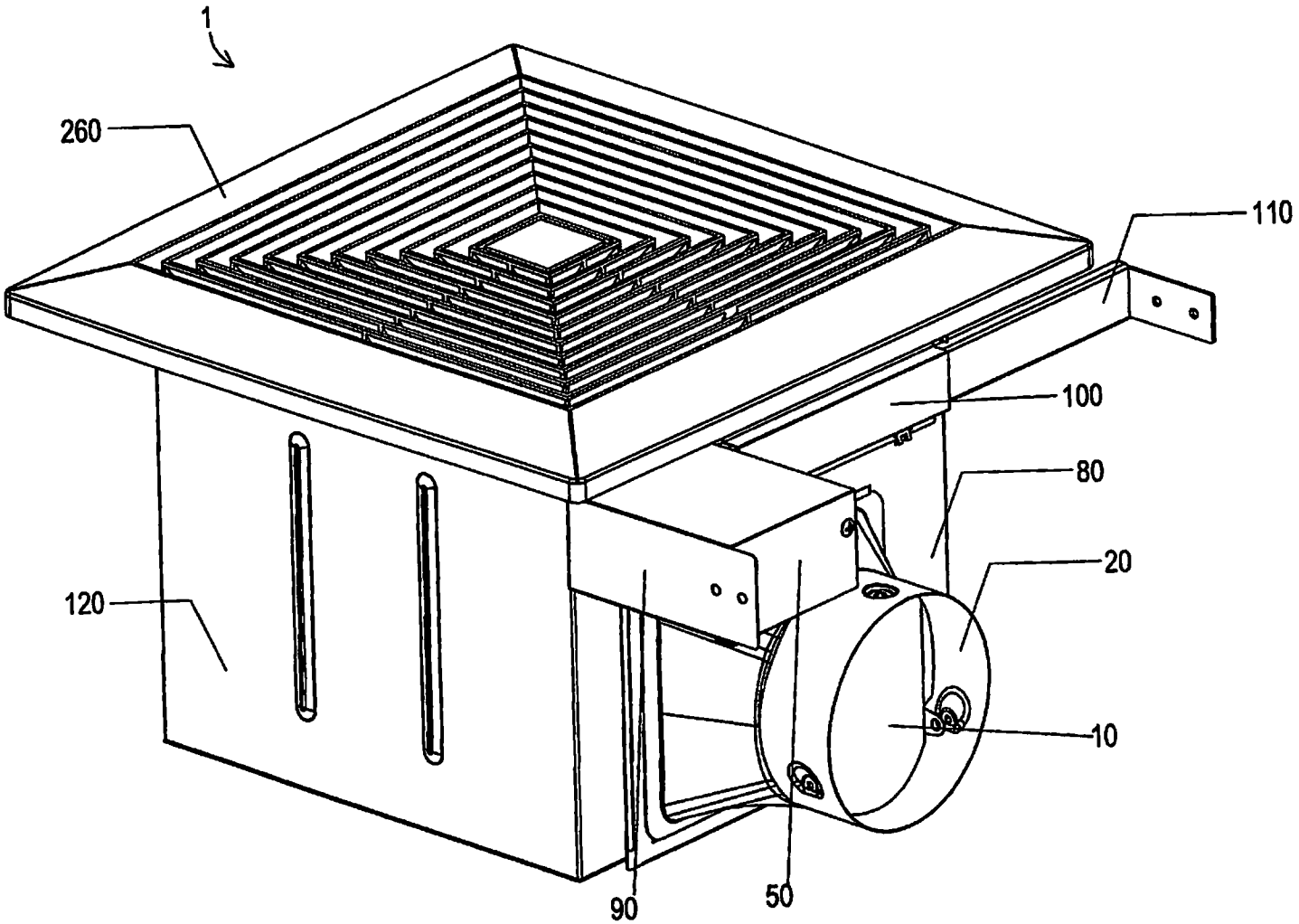
FIG. 10 is a top left front perspective view of the assembled bath fan housing of FIG. 8.
Figure 11:
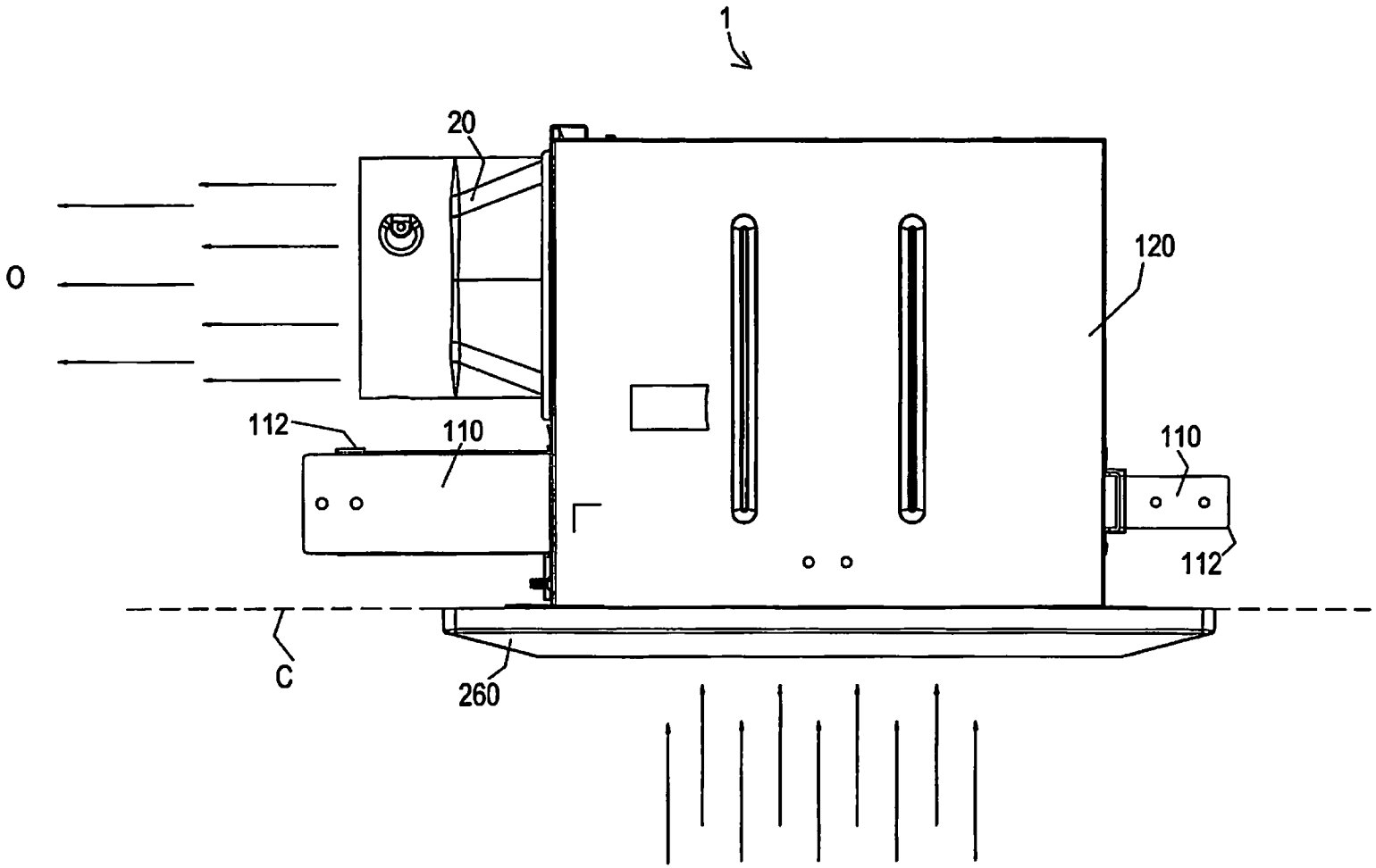
FIG. 11 is a ceiling mounted view of the assembled bath fan of FIG. 8 with airflow arrows.

FIG. 8 is a top view of the assembled bath fan housing of FIG. 6 with grill cover 260. FIG. 9 is a top right front perspective view of the assembled bath fan housing 120 of FIG. 8. FIG. 10 is a top left front perspective view of the assembled bath fan housing 120 of FIG. 8. FIG. 11 is a side mounted view of the assembled bath fan of FIG. 8 with airflow arrows. Referring to FIGS. 1-11, the bath fan 1 can be mounted with the grill cover 260 mounted outside of a ceiling C, with the telescoping suspension brackets 110 mounting the bath fan to joists inside of the ceiling by fasteners connected to both the joists and the bent flange ends 112. Air from a room space below the ceiling mounted bat fan can be drawing in the direction of arrow I into the bath fan housing 120 by the motor operated blower wheel 140 and exhaust to outlet 20 to vent outside of the room and in the direction of arrows O.

80 CFM Bath Exhaust Fans with Telescoping Side Extension Brackets (with Lights)

Additional components will now be describes for this embodiment.

270. 80 CFM with light

271. 13 W CFL bulb

272. GU 24 Socket

273. male plug

274. female receptacle

275. connectors to external electrical supply

276. light box

278. light box fixed plate

280. spring (similar to spring 240)

290. Grill frame (removable light/shade cover)

292. grill vents

292B. side vents

300. grill lens

Figure 12:
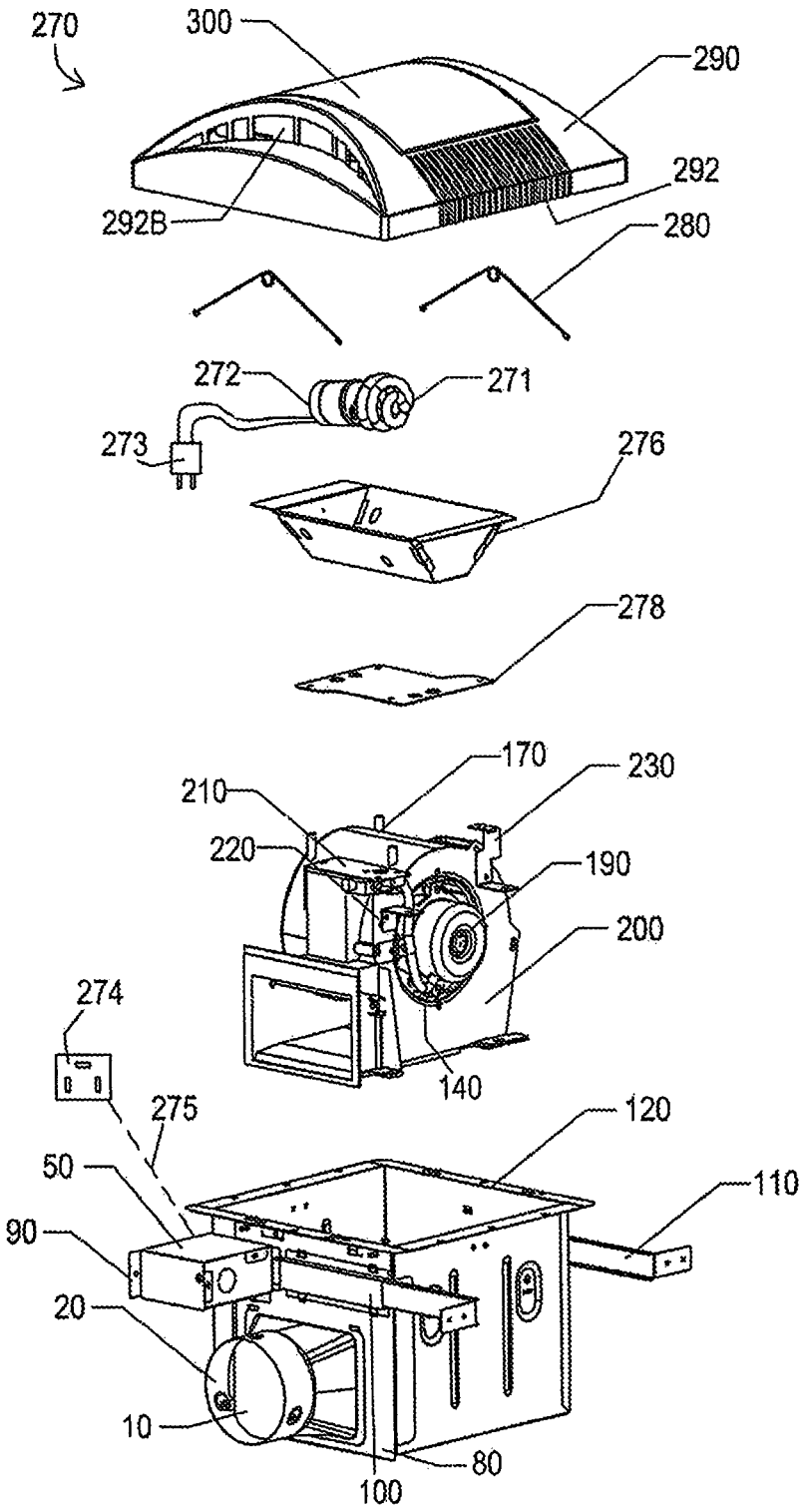
FIG. 12 is an exploded perspective view of an 80 CFM bath fan housing (with no heater) telescoping side extension brackets, side by side motor and blower wheel, with a light.
Figure 13:
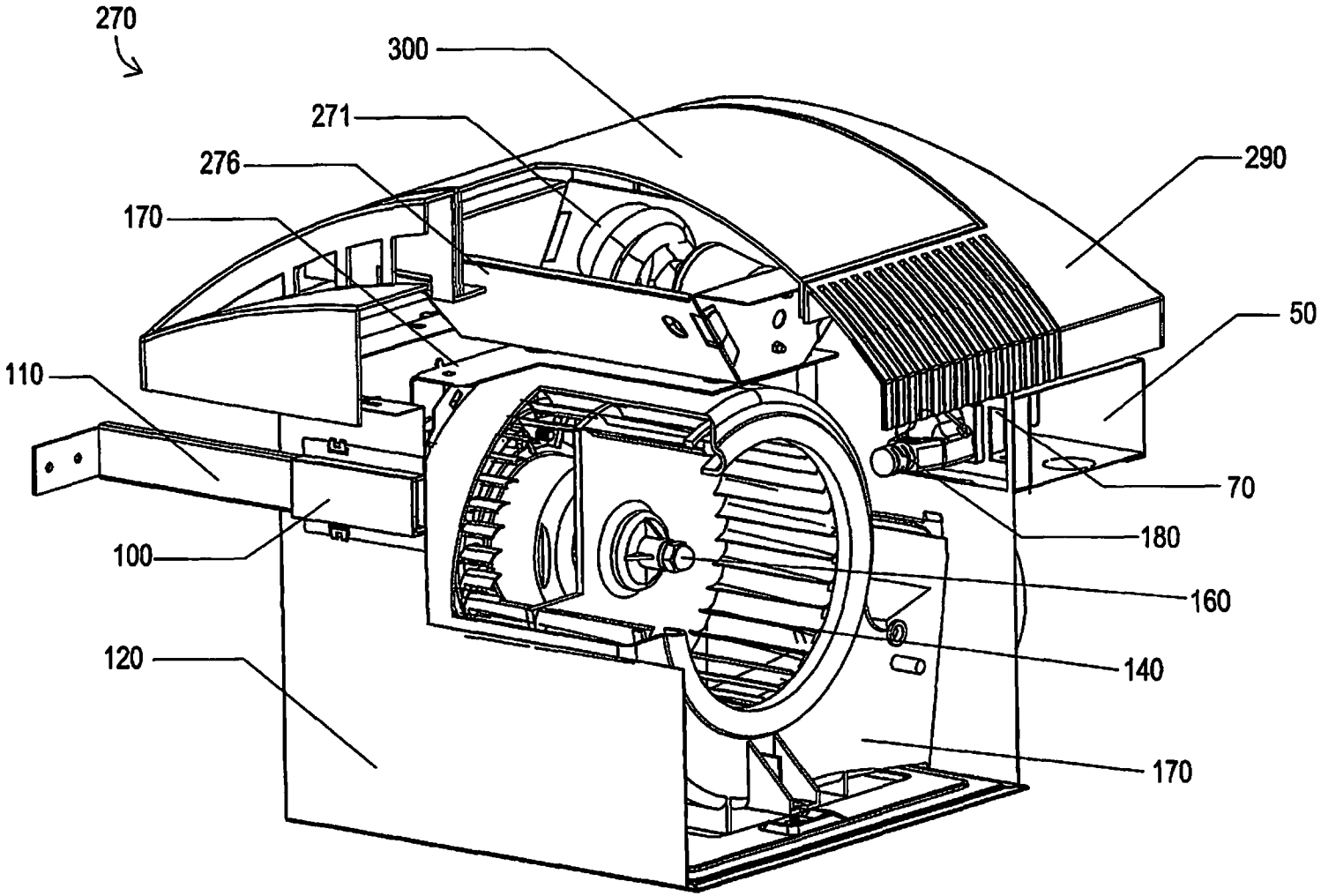
FIG. 13 is an assembled perspective view with partial cut-away along one side of the 80 CFM bath fan housing of FIG. 12 with removable light shade/cover.
Figure 14:
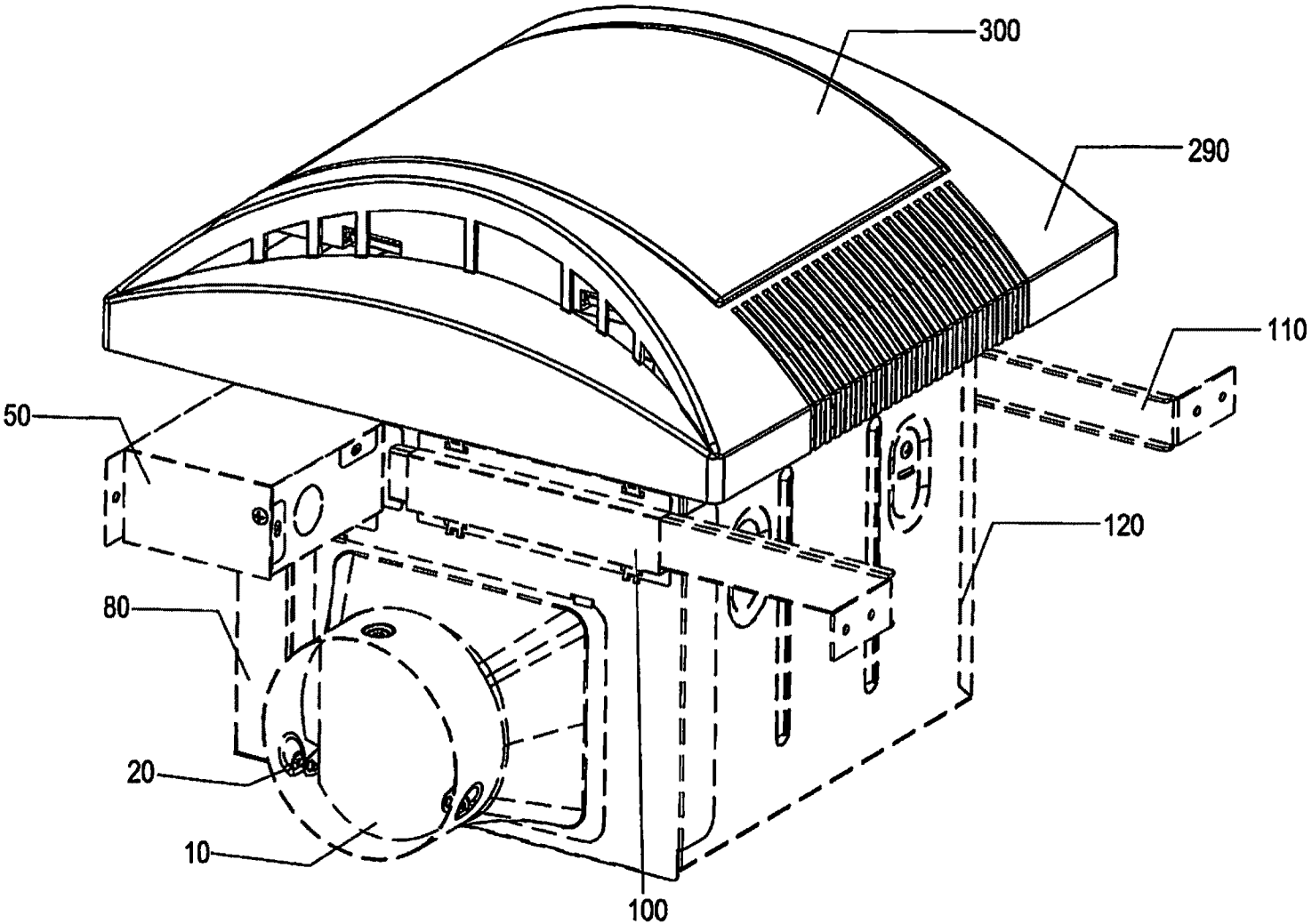
FIG. 14 is another assembled perspective view along another side of the 80 CFM bath fan housing with light/shade cover of FIG. 13
Figure 15:
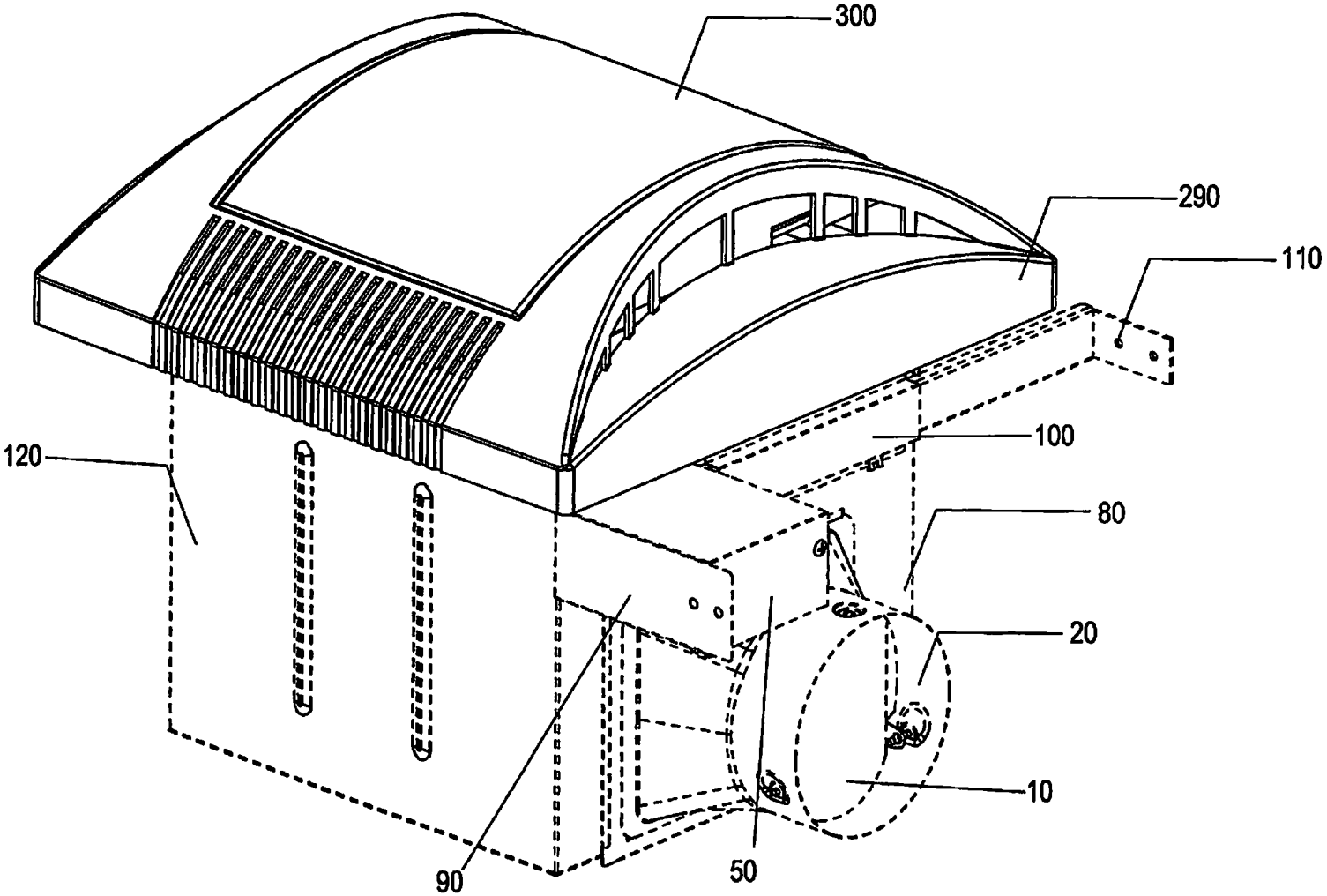
FIG. 15 is still another assembled perspective view along still another side of the 80 CFM bath fan housing with light shade/cover of FIG. 13.

FIG. 12 is an exploded perspective view of an embodiment 270 of an 80 CFM bath fan housing (with no heater) 120, telescoping side extension brackets 110, side by side motor 190 and blower wheel 140, with a light 271. FIG. 13 is an assembled perspective view with partial cut-away along one side of the 80 CFM bath fan housing 120 of FIG. 12 with removable light shade/cover 290. FIG. 14 is another assembled perspective view along another side of the 80 CFM bath fan housing 120 with light/shade cover 290 of FIG. 13. FIG. 15 is still another assembled perspective view along still another side of the 80 CFM bath fan housing 120 with light shade/cover 290 of FIG. 13.

Referring to FIGS. 12-15, the bath fan with light embodiment 270 includes similar components to the previous embodiment described, with the differences of using a light source 270, such as a 13 W CFL bulb that is attached to a socket 272 such as a GU 24 socket that can be mounted by fasteners in a protective metal light box 276. The light box can be attached by fasteners to a light box fixed plate 278 that can be fixably mounted to an upper portion of the blower housing 170. The socket 272 can be wired to a male plug 273 (similar to those previously described), which can be mateably attached to a female receptacle (similar to those previously described) inside of an external wiring box 90. The female receptacle 274 can be wired to an external electrical power supply (similar to the external power supply previously described) via conductors 275.

The grill frame 290 functions similar to the grill cover 260, previously described, and instead can have two or more grill vents 292. In the middle of the grill cover 290 can be a removable lens cover 300. The grill cover 300 can snap into the opening in the center of the grill cover 290 with male and female members (not shown) around the perimeter of the lens cover 300. The grill cover 290 can be attached to the main housing 120 using springs 280, which function similarly to springs 240 that were previously described.

Figure 16:
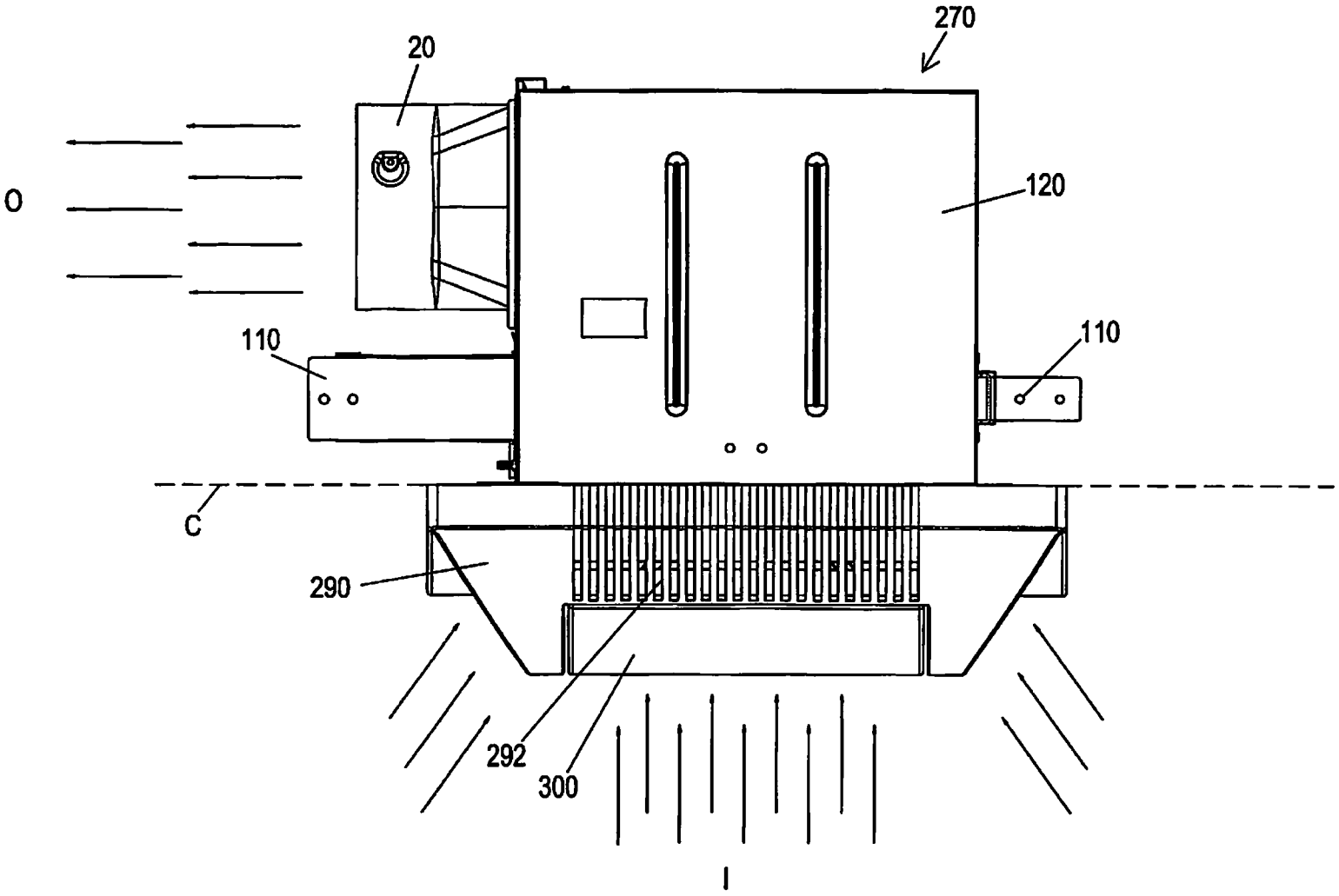
FIG. 16 is a ceiling mounted view of the assembled 80 CFM bath fan housing and light of FIGS. 13-15, and also shows the airflow direction where the air enters the bath fan through the vents of the grill.

FIG. 16 is a ceiling mounted view of the assembled 80 CFM bath fan housing and light embodiment 270 of FIGS. 13-15. Similar to the previously described embodiment 1, the bath fan and light embodiment 270 can be mounted within a ceiling C with the grill cover 290 exposed beneath the ceiling and the bath fan housing 120 secured to joists by the telescoping suspension brackets 110. Here, incoming air can be drawn into the housing 120 through grill vents 292 and side grill vents 292B. The light box 276 prevents incoming air from coming into contact with the bulb (light source) 271. Instead incoming air is drawn around the outside of light box 276 allowing for a heat sink and cooling effect for the heat generated from the light bulb 271.

FIG. 7 is an exploded perspective view of an 80 CFM bath fan housing (with no heater) telescoping side extension brackets, side by side motor and blower wheel, with a light. FIG. 8 is a partial exploded view of the housing of FIG. 1 with removable light shade/cover.

FIG. 9A shows the details of the outlet duct. FIG. 9B shows connection point between outlet duct connected to housing. FIG. 9C shows the plug-in inside the bath fan housing to power the light. FIG. 9D shows the blower wheel connection to the blower wheel housing (#17). FIG. 9E shows the welded C-shaped bracket on the housing.

FIG. 9F shows the connection for how the junction box connects to the bath fan housing. FIG. 9G shows #22, #20, and #13 connection points to form a housing for the blower wheel and then connects to #12 which is the bath fan housing.

FIG. 9H shows the motion sensor that is near #30 (light lens cover). FIG. 9I show how the lens (#30) connects to the grill and is flush against the grill (#29).

FIG. 10 is a side view of an assembled bath fan housing of FIG. 7. FIG. 11 is a partial side cross-sectional view of the bath fan of FIG. 10. FIG. 12 is a bottom partial cross-sectional view of the assembled fan of FIG. 10. FIG. 13 is a side cross-sectional view of the light shade/cover of FIGS. 10-12.

The light shade/cover is held in place by various components. There are 2 plastic pieces that extrude out from the lens cover and you line up the lens cover on one side of the grill so it inserts and then you push in the opposite side of the lens cover then push down so it falls inside the grill and release. Once you release the 2 clips will lock itself in place.

90 CFM Bath Fan with Flush Mount Light & Motor Beneath Blower Wheel

A list of components for FIGS. 17-22 will now be described.

400. 90 CFM bath fan with light.
410. Decorative Nut
420. Decorative Cover
430. Connect screw
440. Glass Shade
450. cloak wire cover
460. socket bracket
470. decorative ring
530. GU24 bulb (2)
540. socket
550. socket
560. circular ball (2)
570. grill frame with vent openings
573. vent openings
576. closed floor of grill frame
580. grill bracket (C shaped to support grill frame 570

Figure 17:
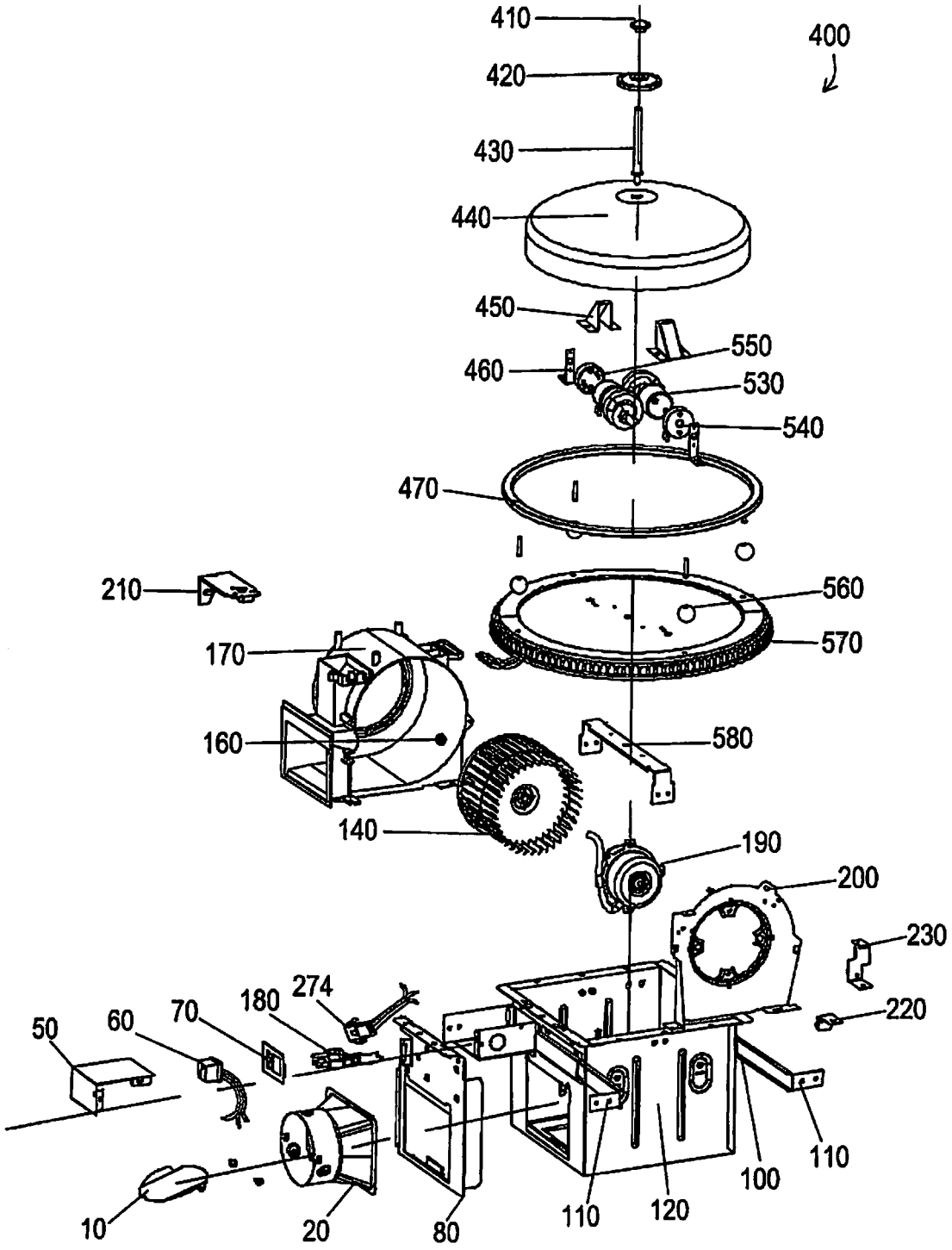
FIG. 17 is an exploded perspective view of an 90 CFM bath fan housing (with no heater) telescoping side extension brackets, separated side by side motor and blower wheel and blower housing, with separated light components.
Figure 19:
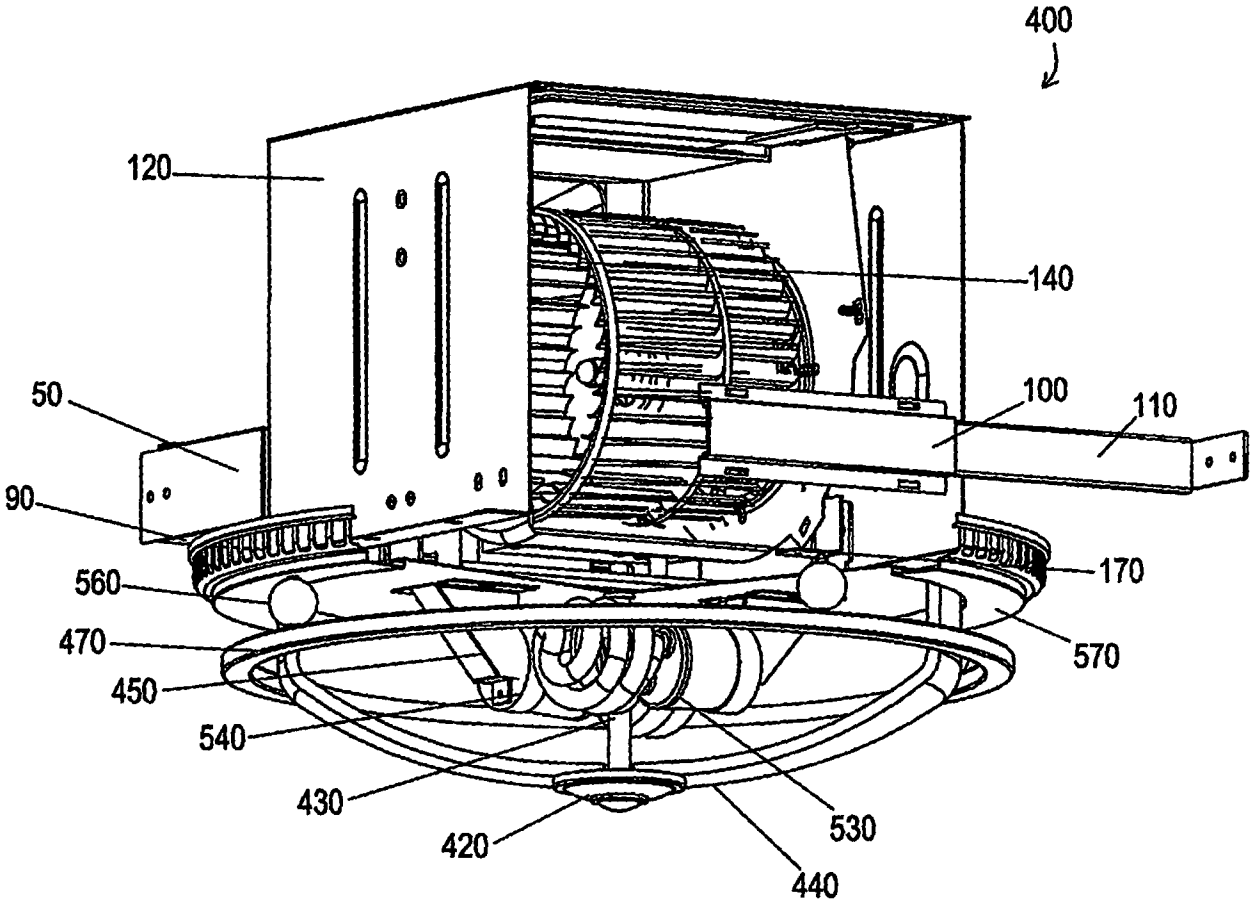
FIG. 19 is an assembled perspective view with partial cut-away along one side of the 90 CFM bath fan housing of FIGS. 17-18 with removable light shade/cover.
Figure 20:
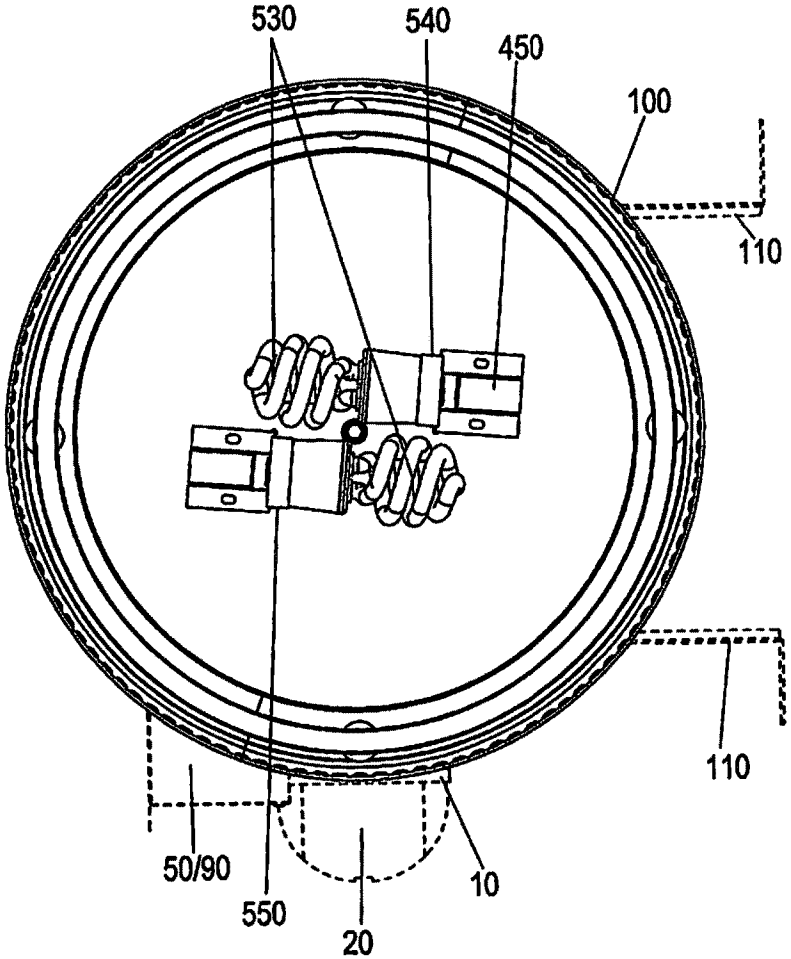
FIG. 20 is a top view of the assembled bath fan housing of FIG. 19 without shade cover.
Figure 21:
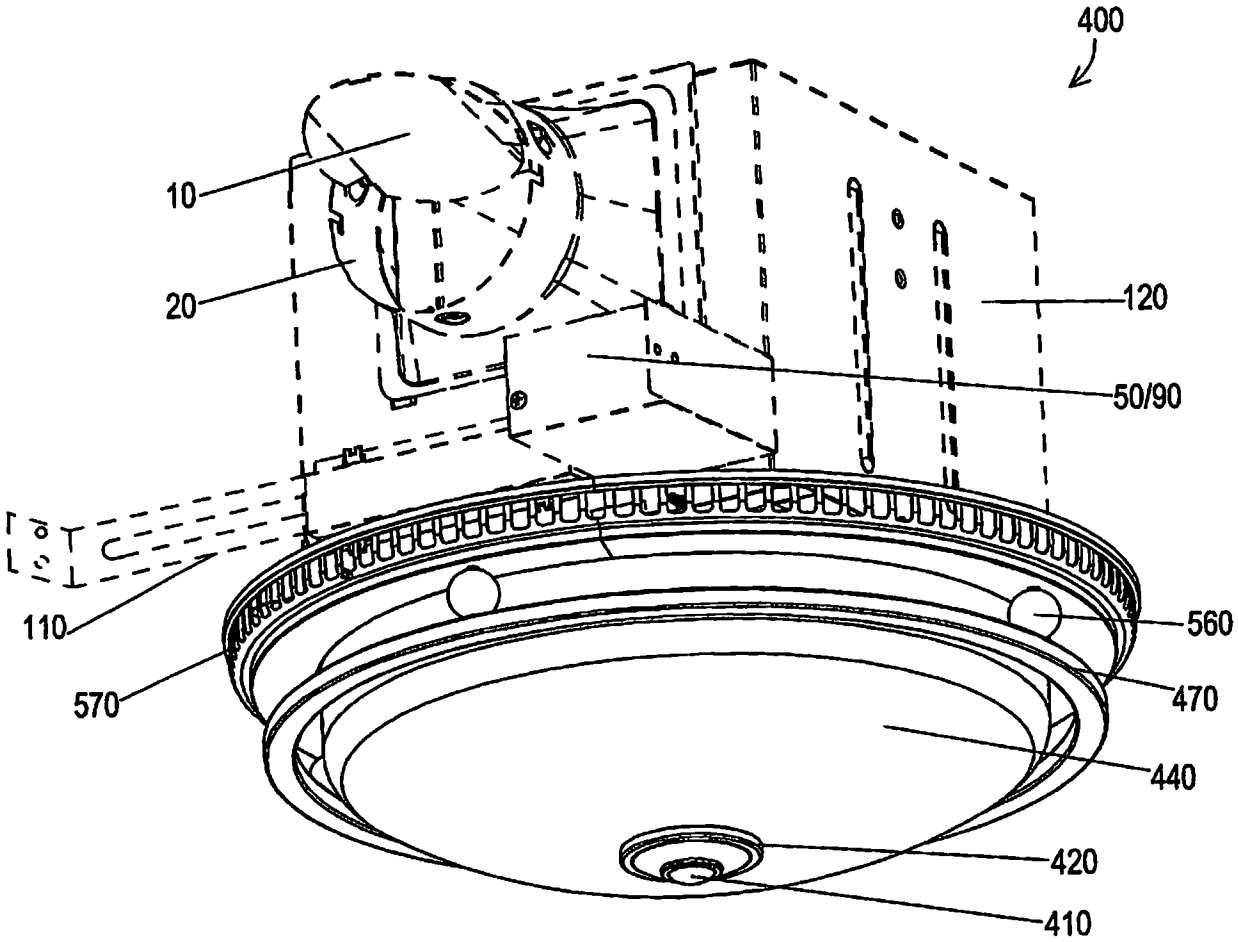
FIG. 21 is a perspective view of the assembled 90 CFM fan housing of FIGS. 17-20.

FIG. 17 is an exploded perspective view 400 of an 90 CFM bath fan housing (with no heater) 120, telescoping side extension brackets 110 with mounted bracket, separated side by side motor 190 and blower wheel 140 and blower housing 170, with separated light components 410-470, 530-580. FIG. 18 is a partial exploded perspective view 400 of FIG. 17 with assembled blower housing 170 containing side by side motor 1990 and blower wheel 140 with partial assembled light components 410-470, 530-580. FIG. 19 is an assembled perspective view with partial cut-away along one side of the 90 CFM bath fan housing 120 of FIGS. 17-18 with removable light shade/cover 440. FIG. 20 is a top view of the assembled bath fan housing 120 of FIG. 19 without shade cover 440. FIG. 21 is a perspective view of the assembled 90 CFM fan housing of FIGS. 17-20.

Referring to FIGS. 17-21, the 90 CFM bath fan embodiment 400 can include basic components similar to those described in the previous embodiments, with different light components 410-470 and 530-580. Covering the top opening of the main housing 120 can be a grill bracket 580 having bent ends that can be attached to inner sides of the main housing 120 by fasteners, and the like. The closed bottom 576 of a circular grill frame 570 can be attached to an upper portion of the grill mounting bracket 580 by additional fasteners, and the like. On the outer perimeter of the grill frame 570 can be vent openings 573. Light sockets 540, 550 can be mounted to the floor 576 of the grill frame 570 by socket brackets 460, with the electrical connection ends protected by cloak wire cover(s) 450. Inside of the sockets 540, 550 can be removable light sources 530, such as but not limited to GU24 bulbs, and the like.

An elongated connect screw 430 can have a bottom end screwably attached to a central portion of the floor 576 of the grill frame 570, and an upper threaded end that is attached to a dome shaped light shade 440 by a decorative nut 410 with decorative cover 420. Connect screw 430 can be threaded inside so it allows for height adjustment to fit standard and thicker ceiling boards as needed.

A decorative ring 470 can be held in place by being fixably adhered to one side ball members 560, with the opposite side of the ball members 560 being adhered to an outer perimeter surface of the grill cover 570. Both 560 and 470 are part of the flush mount design and used and are used for aesthetic purposes.

Figure 22:
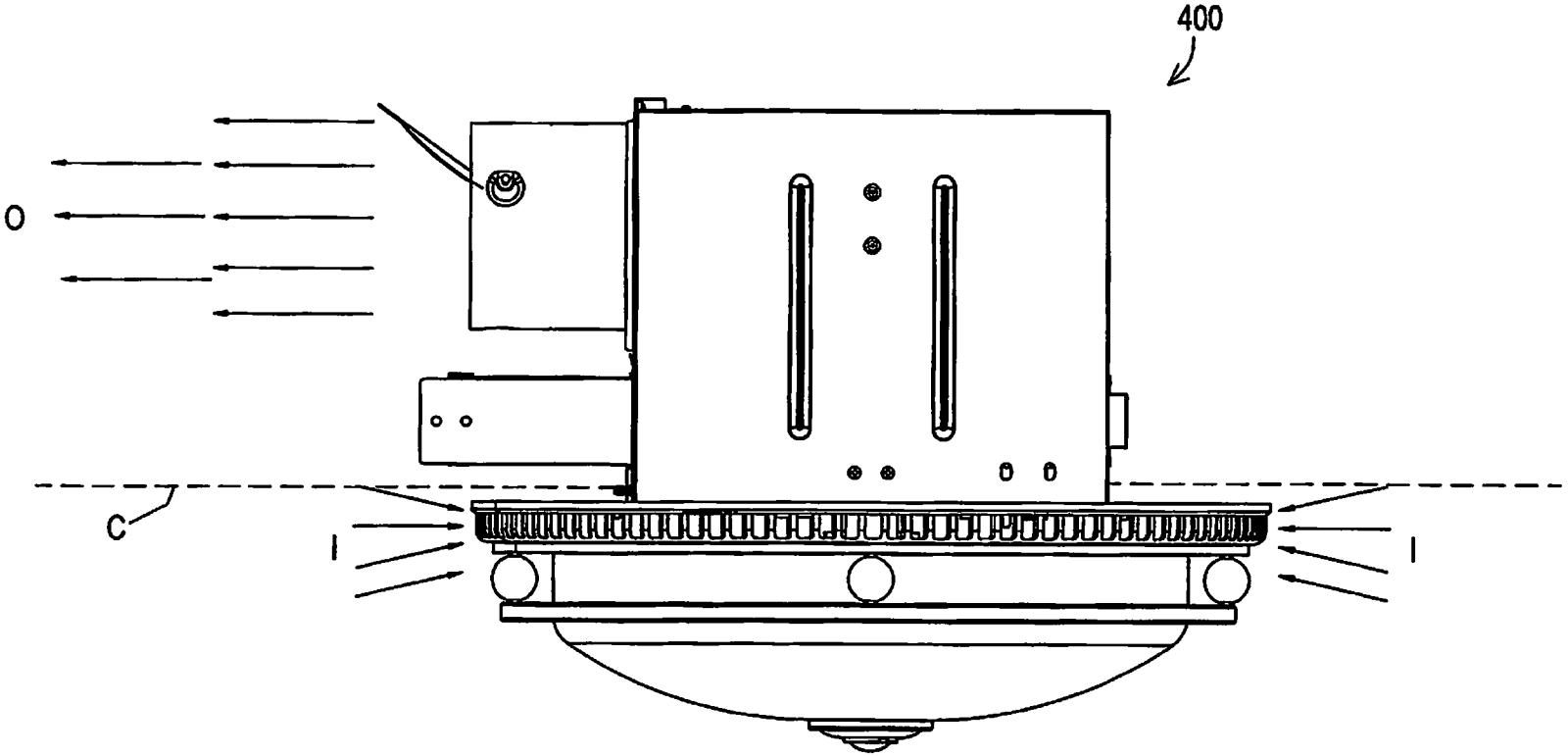
FIG. 22 is a ceiling mounted view of the assembled 90 CFM bath fan housing and light of FIGS. 17-21.

FIG. 22 is a ceiling mounted view 400 of the assembled 90 CFM bath fan housing 120 and light components 410-470, 530-580 of FIGS. 17-21. In operation the bath fan housing can be mounted inside of the ceiling by the telescoping members 100, 110 being attached to structural members, such as joists, and the like, with the grill cover plate being attached beneath the ceiling C. Incoming air is drawn into the housing through perimeter vent openings 573 Vent openings 573 can allow for airflow to pass in because 576 blocks any air from entering the light bulb area. Bottom 576 acts as a platform to secure the light sockets and is air tight because it is 1 piece with 573. 573 allows the flush mount to be raised about ½" from the bath fan housing, just enough to allow for air to enter.

While the invention references fasteners, the fasteners, can be removable fasteners, such as but not limited to screws, bolts, and the like, as well as other types of fasteners, such as rivets, and the like.

Although the preferred embodiments describe the housings to be attached directly to joists in ceilings, the invention can apply to attaching the housings to structural members in walls, and other structural members behind ceilings and/or walls.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exhaust fan, comprising:

a main housing having side walls, top and open bottom, and an exhaust outlet extending from the main housing;

a blower wheel with a blower housing, the blower housing having a support base, with an outlet coupled to the main housing exhaust outlet; and an electrical motor for rotating the blower wheel, the motor and the blower housing form an assembled blower mounted by a vertically oriented plate inside of the main housing, the vertically oriented plate consisting of a rounded top with a vertical tab extending therefrom, and a flat straight base and straight sides extending from the flat straight base, with one of the straight sides being bent into a trapezoidal section with a non-parallel angled side, relative to the vertically oriented plate, first and second side flanges extending perpendicular from the flat straight base of the vertically oriented plate, the first side flange extending perpendicular from a bottom of the bent trapezoidal section, the second side flange being oriented perpendicular to the first side flange, the flat straight base of the vertically oriented plate being attached to the closed top inside of the main housing by the first and the second side extending perpendicular flanges, the vertically oriented plate spaced from one of the side walls of the main housing, the vertically oriented plate having additional flanges extending perpendicular from a side wall of the vertically oriented plate above the base of the vertically oriented plate which attaches the vertically oriented plate to opposite facing perpendicular extending members on an interior surface of the side walls of the main housing, the additional side flanges spaced between the top and the base of the vertically oriented plate, the vertically oriented plate having an opening with equally spaced apart tabs extending into the plate opening for attaching to complementary tabs on the motor.

2. The exhaust fan of claim 1, wherein the motor is an 80 (eighty) CFM (cubic feet per minute) generating motor.

3. The exhaust fan of claim 1, wherein the motor is a 90 (ninety) CFM (cubic feet per minute) generating motor.

4. The exhaust fan of claim 1, further comprising:

a first elongated side telescoping bracket directly mounted along one side wall of the housing.

5. The exhaust fan of claim 4, further comprising:

a second elongated side telescoping bracket directly mounted along an opposite side wall of the housing, the second elongated side telescoping bracket being shorter than the first elongated side telescoping bracket.

6. The ventilating exhaust fan of claim 1, further comprising:

a removable grill with a light covering the open bottom of the main housing, the removable grill only being used to draw air into the main housing of the ventilating exhaust fan.

7. The ventilating exhaust fan of claim 6, further comprising:

a removable light shade that is separately detachable and attachable to the removable grill and light.

8. The ventilating exhaust fan of claim 7, further comprising:

a light box having closed sides and closed bottom with the light being mountable inside of the light box, wherein air being drawn into the main housing by the blower passes around sides of the light box allowing for reducing heat generated from the light.

9. The ventilating exhaust fan of claim 1, further comprising:

a wiring box attached to an exterior side of the housing, wherein the wiring box includes a male plug and a female receptacle inside of the box for supplying an external power supply to the electrical motor.

10. A ventilating exhaust fan of claim 7, further comprising:

an elongated member which adjusts height of the shade relative to the housing.

11. The ventilating exhaust fan of claim 1, wherein the blower housing with blower wheel and motor are mounted generally on a middle portion of the top inside of the main housing generally equal distant from each of the sidewalls.

12. The ventilating exhaust fan of claim 1, wherein the additional flanges include:

a 7 shaped flange; and a Z shaped flange.

* * * * *